US009274448B2

(12) United States Patent
Ishizumi et al.

(10) Patent No.: US 9,274,448 B2
(45) Date of Patent: Mar. 1, 2016

(54) IMAGE FORMING APPARATUS, POSITIONAL DEVIATION DETECTION APPARATUS, AND POSITIONAL DEVIATION DETECTION METHOD

(71) Applicant: CANON KABUSHIKI KAISHA, Tokyo (JP)

(72) Inventors: Keisuke Ishizumi, Hiratsuka (JP); Ken Nakagawa, Yokohama (JP); Shinsuke Kobayashi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/480,428

(22) Filed: Sep. 8, 2014

(65) Prior Publication Data

US 2015/0071687 A1 Mar. 12, 2015

(30) Foreign Application Priority Data

Sep. 11, 2013 (JP) ..... 2013-188450

(51) Int. Cl.
*G03G 15/01* (2006.01)

(52) U.S. Cl.
CPC ..... *G03G 15/0121* (2013.01); *G03G 15/0126* (2013.01); *G03G 2215/0187* (2013.01); *G03G 2215/0648* (2013.01)

(58) Field of Classification Search
CPC ..... G03G 15/0121; G03G 15/0126; G03G 2215/0648; G03G 2215/0187
See application file for complete search history.

(56) References Cited

U.S. PATENT DOCUMENTS

| | | | | |
|---|---|---|---|---|
| 2009/0080915 | A1* | 3/2009 | Hashimoto | 399/39 |
| 2011/0229820 | A1* | 9/2011 | Higa | 430/125.3 |
| 2011/0280633 | A1* | 11/2011 | Ino et al. | 399/301 |
| 2011/0318065 | A1* | 12/2011 | Shimoda | 399/301 |
| 2013/0259496 | A1* | 10/2013 | Kato et al. | 399/40 |

FOREIGN PATENT DOCUMENTS

| | | | |
|---|---|---|---|
| JP | 2001-318501 | A | 11/2001 |
| JP | 2009-223248 | A | 10/2009 |
| JP | 2012-027140 | * | 2/2012 |
| JP | 2012-027140 | A | 2/2012 |
| JP | 2012-237904 | A | 12/2012 |

* cited by examiner

*Primary Examiner* — Sandra Brase

(74) *Attorney, Agent, or Firm* — Canon USA, Inc. IP Division

(57) ABSTRACT

An image forming apparatus includes a first detection unit including a first light receiving element arranged in a direction of normal reflected light reflected from a first positional deviation correction pattern, a second detection unit including a second light receiving element arranged in a different direction of normal reflected light reflected from a second positional deviation correction pattern, and a control unit configured to correct a positional deviation based on a value calculated from a first detection result detected by the first detection unit and a second detection result detected by the second detection unit.

19 Claims, 17 Drawing Sheets

IMAGE FORMING APPARATUS, POSITIONAL DEVIATION DETECTION APPARATUS, AND POSITIONAL DEVIATION DETECTION METHOD

BACKGROUND OF THE INVENTION

1. Field of the Invention

The present invention relates to an image forming apparatus such as, mainly, an electrophotographic or electrostatic copying machine and printer, that can correct a positional deviation in an image. Further, the present invention relates to a positional deviation detection apparatus and a positional deviation detection method for detecting a positional deviation in an image.

2. Description of the Related Art

Currently, in image forming apparatuses for forming color images, there is a growing demand for improvement of stability of their image qualities. The color image is made of, for example, a yellow (Y) toner, a magenta (M) toner, a cyan (C) toner, and a black (Bk) toner. An arbitrary color image can be formed by superimposing toner images formed from the toners of the respective colors on one another. However, electrophotographic color image forming apparatuses may form the toner images of the respective colors with a deviation generated among relative positions thereof due to tolerances of rotational speeds of image bearing members that bear the toners of the plurality of colors, a temperature change in the apparatus, an error in relative positions of a driving member and an image forming member, a change over time, and the like. This is a state with a so-called color deviation generated in a color image. The deviation among the relative positions of the toner images of the respective colors also leads to generation of a deviation in the color image formed by superimposing these toner images on one another, thereby deteriorating an image quality of the color image.

Therefore, conventionally, a positional deviation correction has been periodically performed as a registration operation for correcting relative positional deviation amounts of the toner images of the respective colors. In the positional deviation correction, first, a positional deviation correction pattern is formed on a rotating member such as an intermediate transfer member. Then, a position of a patch of each color as the positional deviation correction pattern is detected by a sensor as a detection unit. More specifically, light is emitted from a light emitting element, and reflection light from the patch and the image bearing member is received by a light receiving element, by which the position of the positional deviation correction pattern is detected. Relative positions of a reference color and another color are identified from a result of the detection, by which a timing at which an image of each color starts to be formed is adjusted in such a manner that a deviation amount between the relative positions becomes zero.

As an example of the positional deviation correction, a technique discussed in Japanese Patent Application Laid-Open No. 2001-318501 corrects the positional deviation by detecting normal reflected light from a toner image as the positional deviation correction pattern and the intermediate transfer member. In the method that detects normal reflected light, edges of the patch of each color at both ends thereof are identified and the position of the patch is determined by utilizing the fact that a large amount of light is reflected from the intermediate transfer member while a small amount of light is reflected from the toner image. Further, a technique discussed in Japanese Patent Application Laid-Open No. 2012-237904 corrects the positional deviation by detecting diffuse reflected light from a toner image as the positional deviation correction pattern and the intermediate transfer member. In the method that detects diffuse reflected light, edges of the patch of each color at both ends thereof are identified and the position of the patch is located by utilizing the fact that a small amount of light is reflected from the intermediate transfer member while a large amount of light is reflected from the toner image.

However, use of the detection methods discussed in Japanese Patent Application Laid-Open No. 2001-318501 and Japanese Patent Application Laid-Open No. 2012-237904 may result in deterioration in accuracy of the detection of the positional deviation correction pattern depending on a status of the image forming apparatus.

For example, in the method that detects normal reflected light as discussed in Japanese Patent Application Laid-Open No. 2001-318501, the accuracy of the positional deviation correction may be deteriorated due to a change on the intermediate transfer member over time. More specifically, as the change on the intermediate transfer member advances more and more over time, a foreign substance, a scratch, and the like may be more highly likely attached or generated on a surface of the intermediate transfer member. Various kinds of members such as a photosensitive drum, a secondary transfer roller, and a conductive brush are in abutment with the outer surface of the intermediate transfer member. Further, at a secondary transfer portion, a recording material such as paper contacts the intermediate transfer member. A scratch may be generated on the outer surface of the intermediate transfer member due to sliding contact with these members, and a discharge current generated between the member or the recording material and the intermediate transfer member. Further, a foreign substance or the like introduced from the outside of the image forming apparatus may be attached onto the outer surface and inner surface of the intermediate transfer member. If such a scratch is generated or such a foreign substance is attached, the scratch or the foreign substance changes the surface state of the intermediate transfer member. The change in the surface state causes a change in an amount of the normal reflected light, thereby deteriorating the detection accuracy.

FIG. 16 illustrates the change in the detection result when the scratch or the foreign substance exists on the intermediate transfer member. A waveform illustrated in FIG. 16 is an output waveform that the sensor outputs by detecting the normal reflected light, when the scratch or the foreign substance exists near the edge of the patch on an upstream side thereof in a rotational direction of the intermediate transfer member. The illustration of FIG. 16 indicates that the detected waveform expands due to a change in an output value, which is caused by the generation of the scratch or the attachment of the foreign substance. The position of the patch is identified from a midpoint between a rising edge and a falling edge detected according to a comparison with a preset threshold value, based on this result. In the example illustrated in FIG. 16, the position of the patch is detected to be a position offset by a distance corresponding to a detection error Δ from an actual position toward the upstream side in the rotational direction of the intermediate transfer member, and this incorrect detection results in deterioration in the accuracy of the positional deviation correction. Further, if the scratch or the foreign substance exists at a position that does not overlap the position of the patch, an output value generated by the scratch or the foreign substance is incorrectly detected as the patch, and this incorrect detection also results in deterioration in the accuracy of the positional deviation correction.

Further, for example, in the method that detects diffuse reflected light as discussed in Japanese Patent Application Laid-Open No. 2012-237904, the accuracy of the positional deviation correction may be deteriorated due to a change in a toner cartridge over time. The method that detects diffuse reflected light is prone to a large change in the amount of the reflection light when a change occurs in a density of the patch. Therefore, a reduction or unevenness in the toner density of the patch may make the output waveform corresponding to the patch asymmetrical, leading to incorrect detection of the position of the patch.

FIG. 17 illustrates output waveforms of the patch before and after endurance of the toner cartridge. The illustration of FIG. 17 indicates that, after the endurance, the density is reduced and becomes uneven, so that the patch exceeds the threshold value at a smaller portion than before the endurance. As a result, a position offset from the actual position is detected as the position of the patch, and this incorrect detection results in deterioration in the accuracy of the positional deviation correction.

SUMMARY OF THE INVENTION

According to an aspect of the present invention, a rotating member, a plurality of development units, configured to form a plurality of positional deviation correction patterns, each of which includes a plurality of patches, onto the rotating member, a first detection unit including a first light receiving element arranged in a direction in which light emitted from a first light emitting element toward a first positional deviation correction pattern and including the plurality of patches, and reflected from the first positional deviation correction pattern is specularly reflected, a second detection unit including a second light receiving element arranged in a direction different from a direction in which light emitted from a second light emitting element toward a second positional deviation correction pattern and including at least a patch formed by the same development unit as a development unit that forms any of the patches included in the first positional deviation correction pattern, and reflected from the second positional deviation correction pattern is specularly reflected, and a control unit configured to correct a positional deviation based on a value calculated from a first detection result detected by the first detection unit and a second detection result detected by the second detection unit.

Further features of the present invention will become apparent from the following description of exemplary embodiments with reference to the attached drawings.

DESCRIPTION OF THE EMBODIMENTS

In the following description, exemplary embodiments of the present invention will be described with reference to the drawings. The exemplary embodiments that will be described below are not intended to limit the present invention according to the scope of the claims thereto. Further, all of combinations of features that will be described in the exemplary embodiments are not necessarily to the solution of the invention.

Description of Image Forming Apparatus

Figure 1:
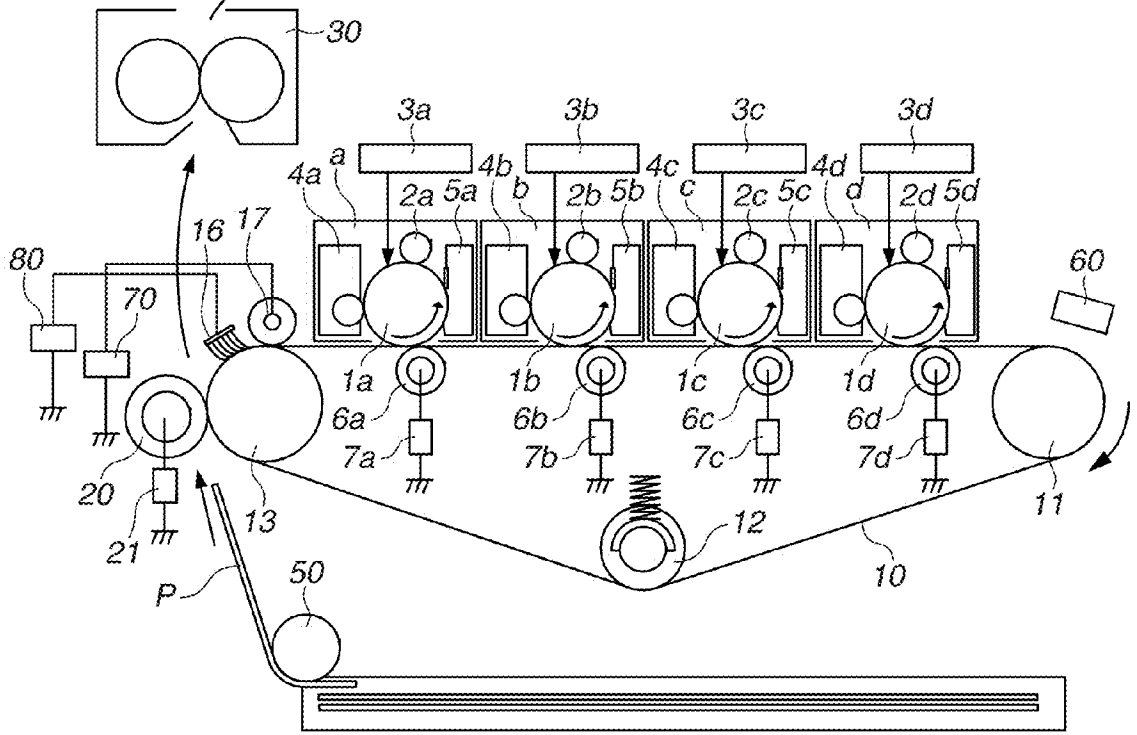
FIG. 1 illustrates an overview of a configuration of an image forming apparatus.

FIG. 1 illustrates an overview of a configuration of an image forming apparatus according to a first exemplary embodiment of the present invention. An image forming apparatus according to the present exemplary embodiment includes first to fourth stations for image formation. The first to fourth stations are for yellow, magenta, cyan, and black, respectively. Further, the image forming apparatus includes a plurality of photosensitive drums (1*a*, 1*b*, 1*c*, and 1*d*), each of which is rotationally driven by a motor (not illustrated) in a direction indicated by an arrow in such a manner that a surface thereof moves at a speed of 100 mm/sec, provided that the diameter of the photosensitive drum 1 is equal to a central value. Then, the present image forming apparatus is an in-line type image forming apparatus that primarily transfers a toner image formed on the photosensitive drum 1 onto an intermediate transfer belt 10 as a rotating member, and superimposes toner images of the respective colors on one another, thereby acquiring a full color image.

In the following description, for convenience of the description, the first station among the four stations will be described. In the drawings, members labeled as reference numerals with alphabets, a, b, c, and d added at ends thereof indicate members for forming yellow, magenta, cyan, and black toner images on the rotating member, i.e., the intermediate transfer belt 10, respectively. However, in the following description, reference numerals with the alphabets, a, b, c, and d removed from ends thereof are used in a case where it is not necessary to distinguish the colors from one another. The photosensitive drum 1 as an image bearing member is evenly charged by a charging roller 2 so as to have a predetermined potential. Subsequently, the photosensitive drum 1 is irradiated with a laser beam by an exposure unit 3. As a result, an electrostatic latent image corresponding to the yellow color among received image signals is formed on the photosensitive drum 1. The electrostatic latent image formed on the photosensitive drum 1 is developed at a development position by a development unit 4 for the yellow color, by which a yellow toner image is visualized.

The yellow toner image formed on the photosensitive drum 1 is subjected to a primary transfer while it is passing through a primary transfer portion where the photosensitive drum 1 and the intermediate transfer belt 10 are in abutment with each other. More specifically, the yellow toner image is transferred onto the intermediate transfer belt 10 with the aid of a primary transfer voltage applied to a primary transfer roller 6 by a primary transfer high-voltage power source 7. A residual toner from the primary transfer, which remains on the photosensitive drum 1, is removed by a cleaning device 5. After that, in a similar manner to the yellow color, a toner image of the magenta color as a second color, a toner image of the cyan color as a third color, and a toner image of the black color as a fourth color are formed, and are transferred onto the intermediate transfer belt 10 while being superimposed on one another sequentially. As a result, a color toner image is formed. During the sequential superimposition of the toner images of the respective colors, superimposition of the toner images at positions offset from actually intended positions, i.e., so-called a color deviation may occur. However, the present image forming apparatus corrects it by positional deviation correction control, which will be described below, thereby forming an image with a positional deviation reduced therein.

The color toner image on the intermediate transfer belt 10 is subjected to a secondary transfer while it is passing through a secondary transfer portion where the intermediate transfer belt 10 and a secondary transfer roller 20 are in abutment with each other. More specifically, the color toner image is collectively transferred onto a surface of a recording material P as paper fed by a paper feeding unit 50 with the aid of a secondary transfer voltage applied to the secondary transfer roller 20 by a secondary transfer high-voltage power source 21. After that, the recording material P with the color toner image transferred thereon is conveyed to a fixing device 30. At the fixing device 30, the toners of the four colors are heated and pressurized, thereby being melted and mixed to be fixed onto the recording material P. The full color image is formed by this operation.

On the other hand, positive polarity toner and negative polarity toner are mixed as a secondary transfer residual toner on the intermediate transfer belt 10 after the secondary transfer. The secondary transfer residual toner is evenly scattered and charged by a conductive brush 16. A positive polarity voltage is applied to the conductive brush 16 by a conductive brush high-voltage power source 80, by which the conductive brush 16 charges the secondary transfer residual toner so that the secondary transfer residual toner has a positive polarity. Further, a positive polarity voltage is applied to a conductive roller 17 by a conductive roller high-voltage power source 70, by which the conductive roller 17 further charges the secondary transfer residual toner so that the secondary transfer residual toner has a positive polarity. The secondary transfer residual toner charged so as to have a positive polarity is transferred onto the photosensitive drum 1 at the primary transfer portion, and is collected by the cleaning device 5 disposed at the photosensitive drum 1.

Description of Intermediate Transfer Belt

The intermediate transfer belt 10 according to the present exemplary embodiment has a perimeter of 650 mm as a central value, and is stretched around three axes of a driving roller 11, a tension roller 12, and a secondary transfer counter roller 13. Then, the intermediate transfer belt 10 is rotationally driven by a rotation of the driving roller 11 with use of the same motor as the motor that rotationally drives the photosensitive drum 1. The intermediate transfer belt 10 is set so that the surface thereof moves at a speed of 100 mm/sec, provided that the diameter of the driving roller 11 is equal to a central value. The surface speed changes depending on a variation in the outer diameter, which is generated when the driving roller 11 is manufactured. Further, a material having a surface glossiness of 30 or higher (measured by Gloss Checker IG-320 manufactured by Horiba Ltd.) is used for the intermediate transfer belt 10 so that normal reflected light can be detected by sensors 60. The above-described perimeter, the material, the driving method, and the like of the intermediate transfer belt 10 are merely examples in the present exemplary embodiment, and the intermediate transfer belt 10 is not limited thereto.

Description of Control Block Diagram

Figure 2:
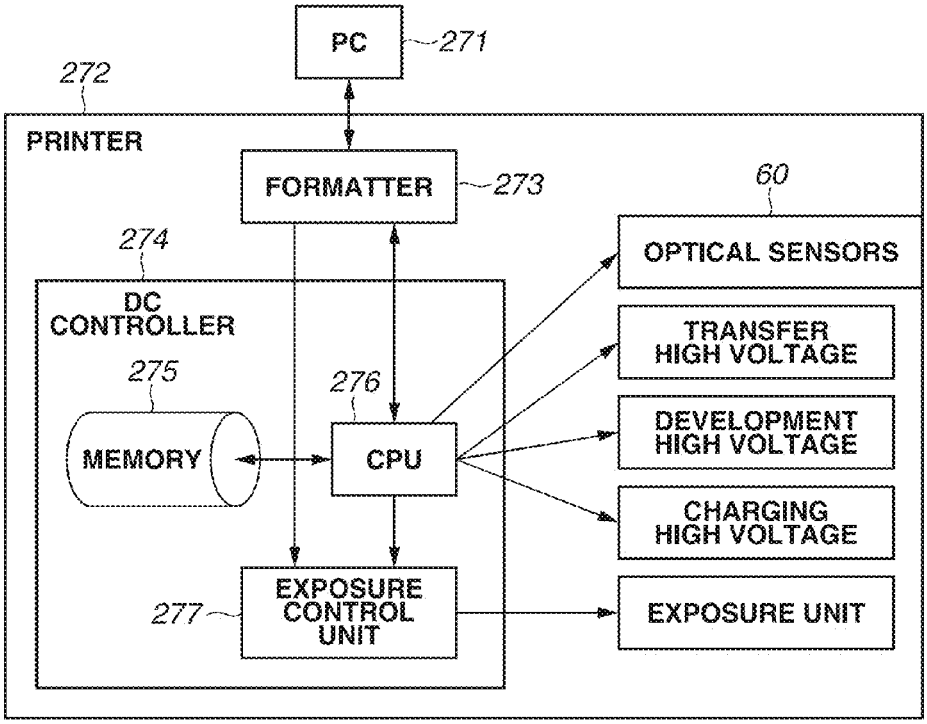
FIG. 2 is a block diagram illustrating control blocks for controlling an operation of the image forming apparatus.

FIG. 2 is a block diagram illustrating control blocks for controlling an operation of the image forming apparatus. A personal computer (PC) 271, which is a host computer, issues a printing instruction to a formatter 273 disposed in the image forming apparatus 272, and transmits image data of an image to be printed to the formatter 273. The formatter 273 converts the image data received from the PC 271 into exposure data, and transfers the converted data to an exposure control unit 277 disposed in a direct current (DC) controller 274. The exposure control unit 277 controls ON and OFF of exposure light to be emitted from the exposure unit 3 based on the exposure data, according to an instruction from a central processing unit (CPU) 276.

The CPU 276 starts an image formation sequence upon receiving a printing instruction from the formatter 273. The CPU 276, a memory 275, and the like are provided in the DC controller 274, and the DC controller 274 performs a preprogrammed operation. The CPU 276 forms an image by controlling a charging high voltage, a development high voltage, and a transfer high voltage to thereby control the formation of the electrostatic latent image, the transfer of the developed toner image, and the like.

Further, the CPU 276 receives detection results from sensors 60*a* and 60*b*, and performs calibration control. The sensors 60*a* and 60*b* detect an amount of light reflected from the surface of the intermediate transfer belt 10 and a patch formed on the intermediate transfer belt 10. A rising edge and a falling edge of a detection signal, which is an output value generated based on the reflection light received by light receiving elements 62*a* and 62*b* from the patch, are identified according to a timing at which the reflection light received by the light receiving elements 62*a* and 62*b* from the patch exceeds or falls below a preset threshold value. The acquired detection signal is stored in the memory 275. The CPU 276 obtains a position of the patch based on the acquired detection signal, and corrects the positional deviation. The sensors 60*a* and 60*b* do not operate during normal image formation, and operates during the positional deviation correction and a density correction.

Description of Sensors

Figure 3A:
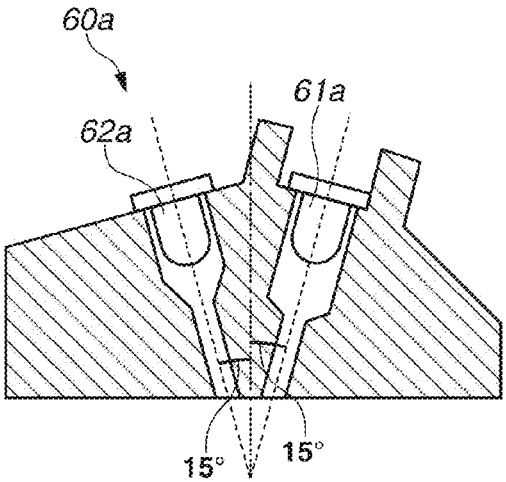
FIGS. 3A and 3B are cross-sectional views of sensors 60*a* and 60*b*, respectively.
Figure 3B:
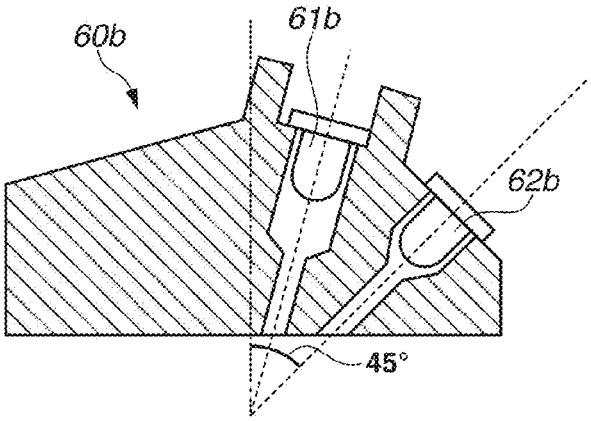

FIGS. 3A and 3B are cross-sectional views of the sensors 60*a* and 60*b*, respectively. FIG. 3A is the cross-sectional view of the sensor 60*a* according to the present exemplary embodiment, and FIG. 3B is the cross-sectional view of the sensor 60*b* according to the present exemplary embodiment. First, the sensor 60*a* will be described with reference to FIG. 3A. The sensor 60*a* includes a light emitting element 61*a* such as a light emitting diode (LED), the single light receiving element 62*a* such as a phototransistor, and a holder. The light emitting element 61*a* is disposed so as to be inclined by 15 degrees from a normal line of the intermediate transfer belt 10, and emits infrared light (for example, light having a wavelength of 950 nm) onto the patch formed on the intermediate transfer belt 10 and the surface of the intermediate transfer belt 10. The light receiving element 62*a* is disposed so as to be inclined by 15 degrees from the normal line of the intermediate transfer belt 10. The light receiving element 62*a* receives the infrared light specularly reflected and the infrared light diffusely (irregularly) reflected from the patch and the surface of the intermediate transfer belt 10, and stores a voltage value corresponding to a value of a current flowing according to an amount of the received light into the memory 275.

Next, the sensor 60*b* will be described with reference to FIG. 3B. The sensor 60*b* includes a light emitting element 61*b* such as an LED, the single light receiving element 62*b* such as a phototransistor, and a holder. The light emitting element 61*b* is disposed so as to be inclined by 15 degrees from the normal line of the intermediate transfer belt 10, and emits infrared light (for example, light having a wavelength of 950 nm) onto the patch formed on the intermediate transfer belt 10 and the surface of the intermediate transfer belt 10. The light receiving element 62*b* is disposed so as to be inclined by degrees from the normal line of the intermediate transfer belt 10. The light receiving element 62*b* receives the infrared light diffusely (irregularly) reflected from the patch and the surface of the intermediate transfer belt 10, and stores a voltage value converted from a value of a current flowing according to an amount of the received light into the memory 275. The light receiving element 62*b* is used with its sensitivity adjusted in such a manner that a sufficient current can flow when the light receiving element 62*b* receives the diffuse reflected light from the patch.

In the present exemplary embodiment, as an example, the sensors 60*a* and 60*b* have been described assuming that the sensors 60*a* and 60*b* are configured to receive normal reflected light and diffuse reflected light, respectively. However, it is not limited thereto, and the sensors 60*a* and 60*b* may be configured to receive diffuse reflected light and normal reflected light, respectively. Further, the sensors 60*a* and 60*b* can be configured as an integrated single unit to form a positional deviation detection device. In this case, even a controller such as a CPU can be provided within the positional deviation detection device. Further, it can be also said that the light receiving element 62*a* of the sensor 60*a* is arranged so as to be located in a direction in which the light is specularly reflected, among directions in which the light emitted from the light emitting element 61*a* is reflected. On the other hand, it can be also said that the light receiving element 62*b* of the sensor 60*b* is arranged so as to be located in a different direction from a direction in which the light is specularly reflected, among directions in which the light emitted from the light emitting element 61*b* is reflected.

Figure 4:
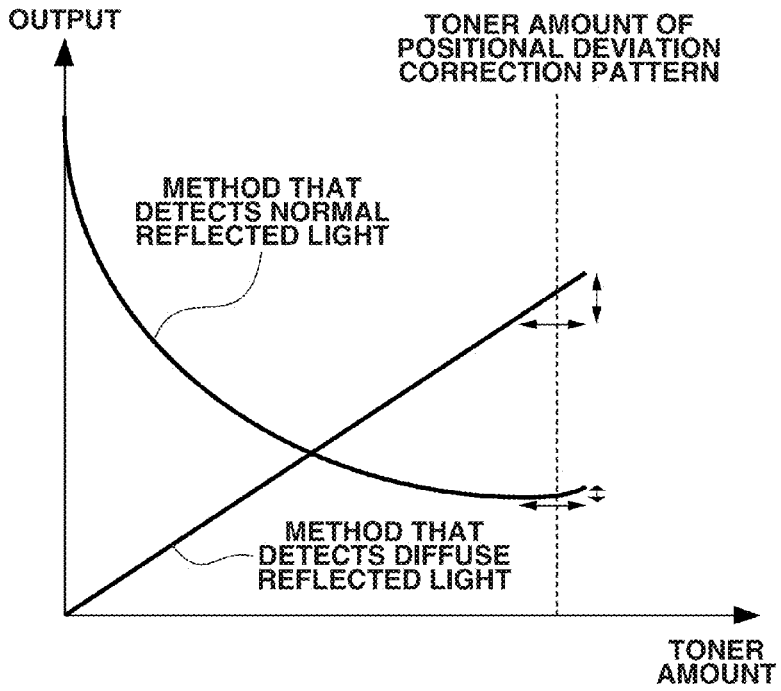
FIG. 4 is a graph illustrating an output by the method that detects normal reflected light, and an output by the method that detects diffuse reflected light with respect to a toner amount.

Output Waveforms by Method that Detects Normal Reflected Light and Method that Detects Diffuse Reflected Light FIG. 4 is a graph illustrating an output by the method that detects normal reflected light and an output by the method that detects diffuse reflected light with respect to a toner amount. The reflection light corresponding to a portion of the infrared light emitted from the light emitting element that is reflected from the intermediate transfer belt 10 is mainly normal reflected light. On the other hand, the reflection light from the patch contains diffuse reflected light in a ratio increasing as a toner amount (a density) of the patch increases, and entirely consists of diffuse reflected light when the toner amount is sufficient.

The method that detects normal reflected light has such a tendency that the output monotonously decreases first as the toner amount of the patch gradually increases, starting from no patch formed on the surface of the intermediate transfer belt 10. However, the diffuse reflected light from the toner increases according to the increase in the toner amount of the patch, whereby a decrease rate of the output is gradually becoming flat, and then the output slightly increases around a solid density, which is the density of the positional deviation correction pattern. Therefore, in the method that detects normal reflected light, the output changes little even if the density of the patch somewhat changes, so that the change in the density of the patch has only a small influence on the positional deviation correction control.

On the other hand, in the method that detects diffuse reflected light, the reflection light is almost undetected with no patch formed on the surface of the intermediate transfer belt 10. The diffuse reflected light increases as the toner amount of the patch increases, and the output is proportional to the toner amount of the patch. In the method that detects diffuse reflected light, the light receiving element 62*b* is adjusted so as to have a higher sensitivity to the amount of the reflection light so that the change in the output becomes sensitive to the change in the density of the patch. As a result, the positional deviation correction control is highly affected by the change in the density of the patch due to a change in a toner cartridge over time or the like.

Description of Method for Detecting Position of Patch

Next, a method for detecting the position of the patch with use of the sensor 60*a* will be described. The reflection light corresponding to a portion of the infrared light emitted from the light emitting element 61*a* that is reflected from the intermediate transfer belt 10 is mainly normal reflected light. Further, reflection light from a yellow, magenta, or cyan patch is diffuse reflected light. Further, the infrared light is mainly absorbed when it is emitted to a black patch.

Figure 5:
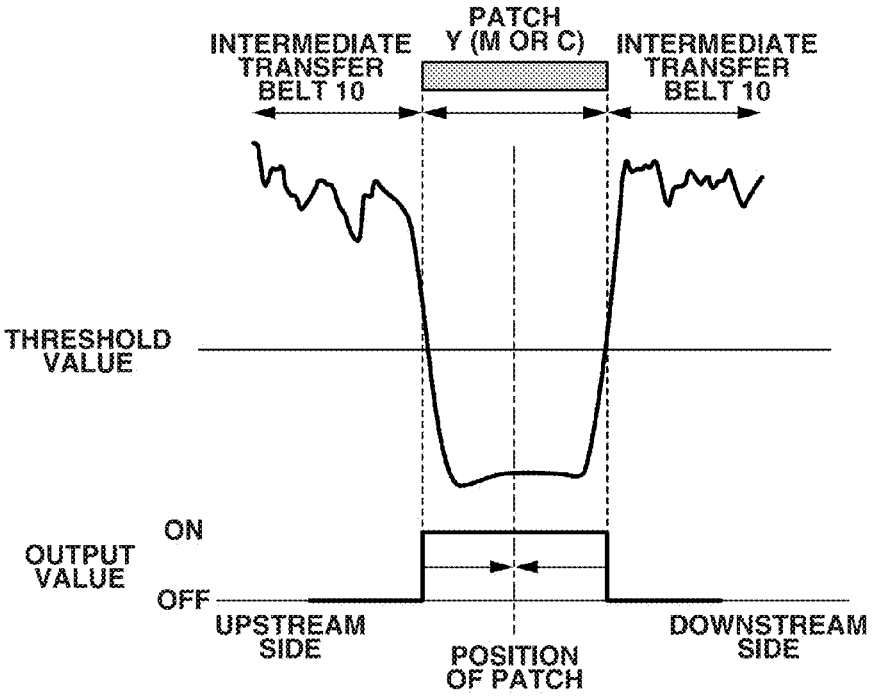
FIG. 5 illustrates an output waveform detected by a light receiving element 62*a* when a yellow patch passes through the sensor 60*a*.

FIG. 5 illustrates an output waveform detected by the light receiving element 62*a* when the yellow patch passes through the sensor 60*a* by way of example. The light receiving element 62*a* is disposed so as to mainly detect normal reflected light, and therefore produces a large output with respect to the reflection light from the intermediate transfer belt 10 while producing a small output with respect to the reflection light from the patch. Therefore, a timing at which the output waveform changes beyond the preset threshold value at a fall of the output waveform is identified as an edge of the patch on a front side in a direction in which the patch is conveyed. Further, a timing at which the output waveform changes beyond the threshold value at a rise of the output waveform is identified as an edge of the patch on a back side in the direction in which the patch is conveyed. Then, a midpoint between the passage timing of the falling edge and the passage timing of the rising edge is identified as the position of the patch. The positions of the magenta, cyan, and black patches are also detected according to a similar method.

Figure 6:
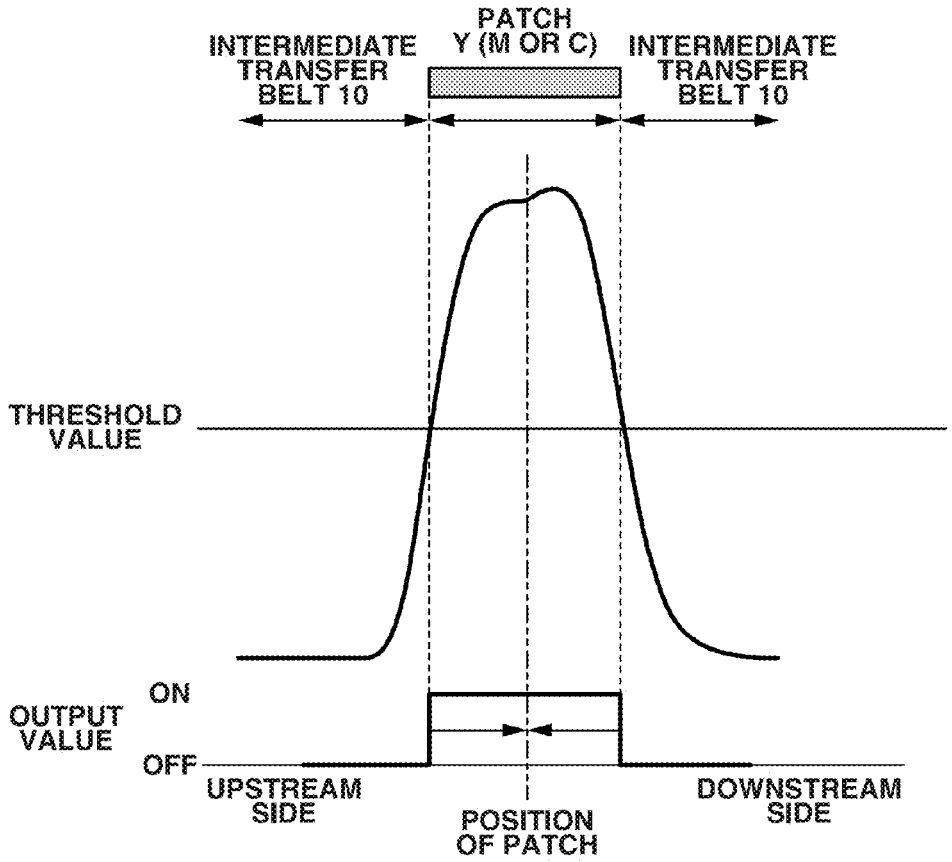
FIG. 6 illustrates an output waveform detected by a light receiving element 62*b* when the yellow patch passes through the sensor 60*b*.

Next, a method for detecting the position of the patch with use of the sensor 60*b* will be described. FIG. 6 illustrates an output waveform detected by the light receiving element 62*b* when the yellow patch passes through the sensor 60*b* by way of example. Since the light receiving element 62*b* is disposed so as to detect diffuse reflected light, the light receiving element 62*b* produces a small output with respect to the reflection light from the intermediate transfer belt 10 while producing a large output with respect to the reflection light from the patch. Therefore, a timing at which the output waveform changes beyond the preset threshold value at a rise of the output waveform is identified as the edge of the patch on the front side in the direction in which the patch is conveyed. Further, a timing at which the output waveform changes beyond the threshold value at a fall of the output waveform is identified as the edge of the patch on the back side in the direction in which the patch is conveyed. Then, a midpoint between the passage timing of the falling edge and the passage timing of the rising edge is identified as the position of the patch. The positions of the magenta and cyan patches are also detected according to a similar method.

On the other hand, the black patch mainly absorbs the infrared light, so that the light receiving element 60*b* produces a small output with respect to the reflection light from the black patch. The sensor 60*b*, which detects diffuse reflected light, can little detect the normal reflected light from the intermediate transfer belt 10, either. Therefore, almost no difference is made between the outputs from the intermediate transfer belt 10 and the black patch. As a result, it is difficult to detect a boundary between the black patch and the intermediate transfer belt 10, which makes it difficult to accurately detect edges of the black patch. Therefore, the edges of the black patch are detected by forming a patch with black patches overlaid on a yellow patch on both ends thereof.

Figure 7:
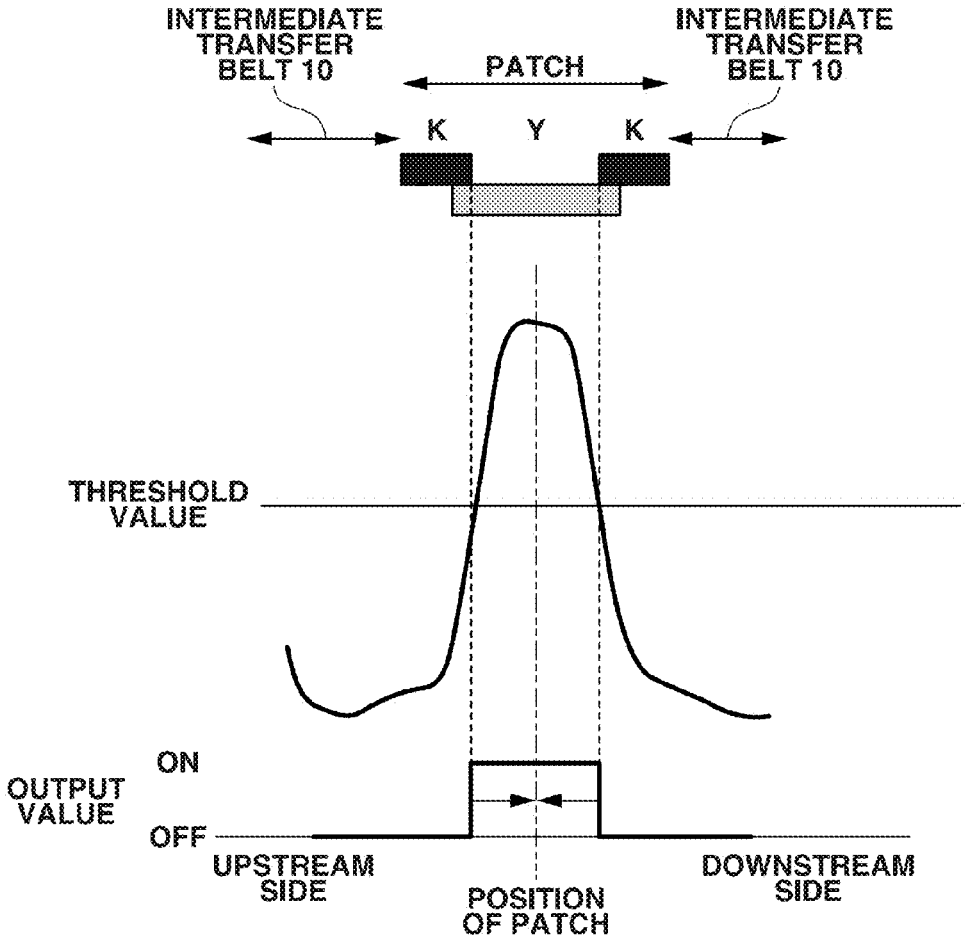
FIG. 7 illustrates an output waveform detected by the light receiving element 62*b* when a patch formed by overlaying black patches on a yellow patch at both ends thereof passes through the sensor 60*b*.

FIG. 7 illustrates an output waveform detected by the light receiving element 62*b* when the patch formed by overlaying the black patches on the yellow patch at the both ends thereof passes through the sensor 60*b*. Although the light receiving element 62*b* produces only small outputs with respect to the reflection light from the black patches, the light receiving element 62*b* produces a large output with respect to the reflection light from the yellow patch. Therefore, the output waveform rises when the yellow patch is detected after the black patch has passed, and the output waveform falls when the black patch is detected after the yellow patch has passed. Since the black patches are overlaid on the yellow patch at the both ends thereof, the edges acquired from the reflection light from the yellow patch can be regarded as the edges of the black patch. Therefore, a midpoint between these rising edge and falling edge is identified, and this midpoint can be determined as the position of the black patch.

The patch laid under the black patches is not limited to the yellow patch, and may be formed by any toner that contains a highly diffusely reflective color material such as magenta and cyan. Further, similarly, the position of the black patch can be also detected by forming a patch with yellow patches overlaid on a black patch at both ends thereof. More specifically, in this case, the upwardly protruding output waveform illustrated in FIG. 7 is changed into a downwardly protruding output waveform, and therefore the position of the black patch can be detected by identifying a falling edge, a rising edge, and then a midpoint therebetween. Further, the threshold value for the edge detection may be any value within a range allowing the falling edge and rising edge of the patch to be detected. Individual threshold values may be prepared for the respective toner colors, or a same threshold value may be prepared for all of the toner colors. Further, individual threshold values may be prepared for the respective sensors 60*a* and 60*b*.

Use of Both Method that Detects Normal Reflected Light and Method that Detects Diffuse Reflected Light Next, a sensor configuration according to the present exemplary embodiment will be described. The method that detects normal reflected light is employed for the sensor 60*a*, which is on one side, and the method that detects diffuse reflected light is employed for the sensor 60*b*, which is on the other side. As a result, it is possible to reduce the deterioration in the accuracy of the positional deviation correction even if a change occurs in the intermediate transfer belt 10 or the toner cartridge over time. The mechanism therefor will be described below.

Figure 8:
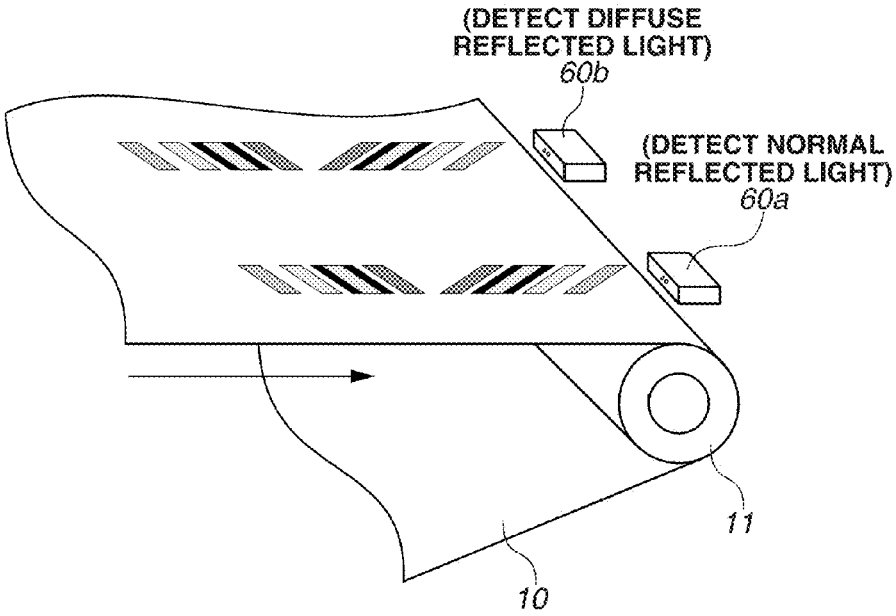
FIG. 8 illustrates positions of the sensors 60*a* and 60*b*, and positional deviation correction patterns.

FIG. 8 illustrates positions of the sensors 60*a* and 60*b*, and positional deviation correction patterns according to the present exemplary embodiment. The sensor 60*a*, which detects normal reflected light, and the sensor 60*b*, which detects diffuse reflected light, are disposed so as to detect regions (detection regions) that do not overlap each other in a width direction of the intermediate transfer belt 10. Further, the positional deviation correction patterns are formed according to the detection regions of the respective sensors 60*a* and 60*b*. Further, in the present exemplary embodiment, the positional deviation correction patterns to be respectively detected by the sensors 60*a* and 60*b* are formed as a same pattern by way of example. However, they do not necessarily have to be formed as a same pattern, and the pattern for normal reflected light and the pattern for diffuse reflected light may be formed as different patterns.

Figure 9:
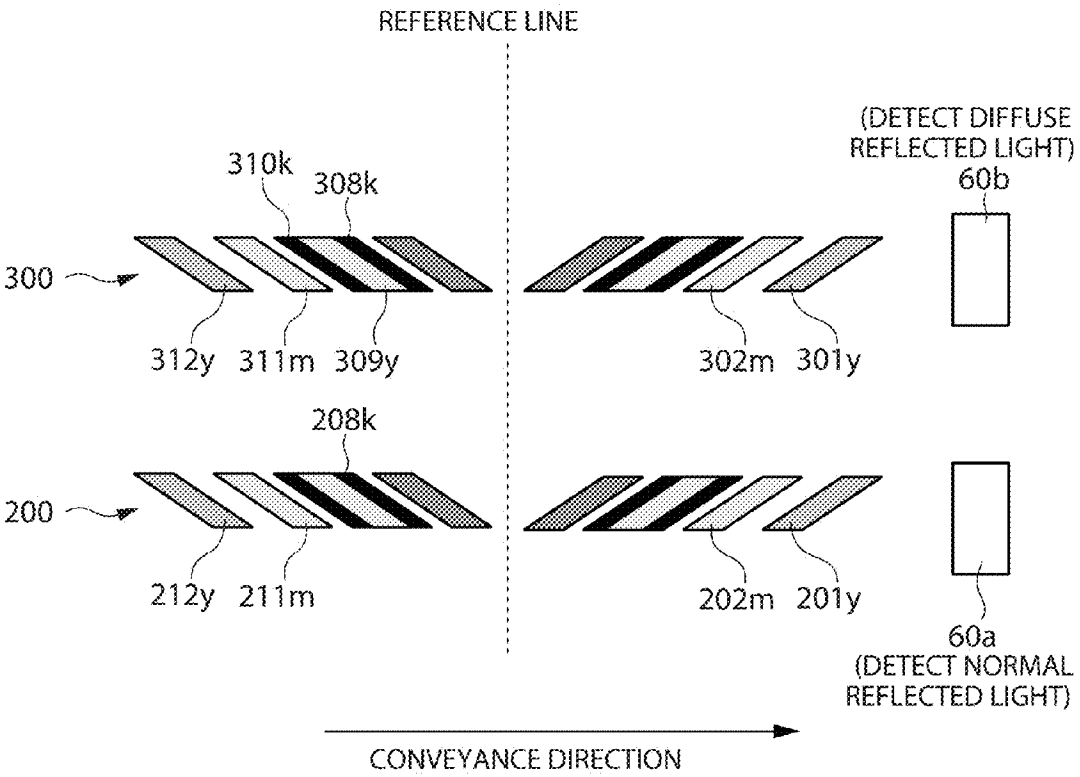
FIG. 9 illustrates details of the patches as the positional deviation correction patterns.

FIG. 9 illustrates details of the patches as the positional deviation correction patterns. A positional deviation correction pattern 200 illustrated in FIG. 9 is patches to be detected by the sensor 60*a*, and a positional deviation correction pattern 300 illustrated in FIG. 9 is patches to be detected by the sensor 60*b*. The respective positional deviation correction patterns 200 and 300 are formed as unfixed images so that they do not overlap each other in a direction perpendicular to a direction in which the intermediate transfer belt 10 is conveyed. Each of the positional deviation correction patterns 200 and 300 includes yellow patches that have parallelogram shapes directed reversely to each other, magenta patches that have parallelogram shapes directed reversely to each other, cyan patches that have parallelogram shapes directed reversely to each other, and black patches that have parallelogram shapes directed reversely to each other. The respective patches are inclined by an angle of 45 degrees from the direction in which the intermediate transfer belt 10 is conveyed. Further, the respective patches are formed in such a manner that, if there is no relative positional deviation amount among them, i.e., a relative positional deviation amount is zero among them, an interval between adjacent patches having parallelogram shapes directed in the same direction becomes equal to an interval between adjacent patches having parallelogram shapes directed in the reverse direction. The patch for the black color is formed by overlaying black patches on a yellow patch at both ends thereof, to allow the position of the black patch to be detected even by the sensor 60*b* that detects diffuse reflected light. Further, the respective patches are formed so as to have a symmetrical relationship about a reference line illustrated in FIG. 9. As an example, in FIG. 9, the positional deviation correction patterns 200 and 300 are not continuously connected in the direction perpendicular to the direction in which the intermediate transfer belt 10 is conveyed. However, it is not limited thereto, and the positional deviation correction patterns 200 and 300 may be formed so as to be continuously connected in the direction perpendicular to the direction in which the intermediate transfer belt 10 is conveyed.

Next, a method for calculating a relative positional deviation amount between different colors will be described. For convenience of the description, this method will be described focusing on a method for calculating a relative positional deviation amount of the magenta color from the yellow color in a sub scanning direction. The positions identified from the result of the detection of the patch edges as described above are used as the positions of the patches used to calculate the relative positional deviation amount.

First, a relative temporal deviation rRpym in the sub scanning direction can be calculated according to the following equation (1), assuming that rY1, rM1, rM2, and rY2 represent timings at which ideal positions of patches 201*y*, 202*m*, 211*m*, and 212*y* pass through the sensor 60*a* from a reference time, respectively.

$$rRpym=(rM1-rY1)+(rM2-rY2) \quad (1)$$

According to the equation (1), (rM1−rY1)=(rY2−rM2) when rRpym=0.

This means that the interval between the magenta and yellow patches is equal between the parallelograms directed differently from each other. The positional deviation correction pattern 200 illustrated in FIG. 9 is formed so that the interval between the magenta and yellow patches becomes equal to the interval between the parallelograms directed differently therefrom, when no color deviation is generated in the sub scanning direction. Therefore, "rRpym=0" means that no relative positional deviation is generated in the sub scanning direction. Further, "rRpym>0" means that an image is formed onto the magenta photosensitive drum 1 at a delayed timing so that the image formation position is offset from an ideal image formation position in a reverse direction of the rotational direction of the intermediate transfer belt 10. Further, "rRpym<0" means that an image is formed onto the magenta photosensitive drum 1 at an early timing so that the image formation position is offset from the ideal image formation position in the rotational direction of the intermediate transfer belt 10.

The relative positional deviation amount of the magenta color from the yellow color can be calculated as a distance by multiplying the relative temporal deviation rRpym by the process speed 100 mm/sec. The color deviation can be corrected by adjusting the image formation timing of the magenta color by a time corresponding to the relative positional deviation amount of the magenta color, which is acquired as a result of the calculation.

Next, the relative temporal deviation rRpym in the sub scanning direction is expressed by the following equation (2), assuming that ΔrY1, ΔrM1, ΔrM2, and ΔrY2 represent error amounts when the patches 201*y*, 202*m*, 211*m*, and 212*y* are detected by the sensor 60*a* based on the reference time, respectively.

$$rRpym=\{(rM1+\Delta rM1)-(rY1+\Delta rY1)\}+\{(rM2+\Delta rM2)-(rY2+\Delta rY2)\}=\{(rM1-rY1)+(rM2-rY2)\}+\{(\Delta rM1-\Delta rY1)+(\Delta rM2-\Delta rY2)\} \quad (2)$$

The error amounts ΔrY1, ΔrM1, ΔrM2, and ΔrY2 correspond to errors generated due to existence of a scratch or a foreign substance at positions corresponding to the patches on the intermediate transfer belt 10, whereby the possibility of occurrence of the errors increases according to a change on the intermediate transfer belt 10 over time. In this manner, the detection with use of the sensor 60*a* results in calculation of a relative positional deviation amount more largely different from the position where the patch is actually formed, as the second term "{(ΔrM1−ΔrY1)+(ΔrM2−ΔrY2)}" in the equation (2) becomes larger.

On the other hand, suppose that dY1, dM1, dM2, and dY2 represent timings when ideal positions of patches 301*y*, 302*m*, 311*m*, and 312*y* pass through the sensor 60*b*. Further, assuming that ΔdY1, ΔdM1, ΔdM2, and ΔdY2 represent error amounts from the ideal positions when the respective patches are detected, a relative positional deviation dRpym in the sub scanning direction that is acquired by the method that detects diffuse reflected light is expressed by the following equation, an equation (3).

$$dRpym=\{(dM1+\Delta dM1)-(dY1+\Delta dY1)\}+\{(dM2+\Delta dM2)-(dY2+\Delta dY2)\} \quad (3)$$

Since the error amounts ΔdY1, ΔdM1, ΔdM2, and ΔdY2 tend to increase due to reductions in the toner amounts of the patches, they tend to increase according to changes in the toner cartridges over time.

The relative positional deviation amount in the sub scanning direction may change depending on a position in the width direction of the intermediate transfer belt 10. Therefore, even if the positional deviation is corrected by a correction of the image formation timing in the sub scanning direction based on the detection result at the position of the sensor on one side, the positional deviation may fail to be appropriately corrected at the position of the sensor on the other side. The present exemplary embodiment calculates an average of the detection result produced by the sensor 60*a*, which operates according to the method that detects normal reflected light, and the detection result produced by the sensor 60*b*, which operates according to the method that detects diffuse reflected light. The present exemplary embodiment corrects a positional deviation from an entire image in the sub scanning direction by correcting the image forming timing in the sub scanning direction based on a result of the average calculation. According to the present exemplary embodiment, a relative positional deviation Rpym is expressed by the following equation, an equation (4).

$$Rpym=(rRpym+dRpym)/2=[\{(rM1+\Delta rM1)-(rY1+\Delta rY1)\}+\{(rM2+\Delta rM2)-(rY2+\Delta rY2)\}+\{(dM1+\Delta dM1)-(dY1+\Delta dY1)\}+\{(dM2+\Delta dM2)-(dY2+\Delta dY2)\}]/2$$

$$=\{(rM1-rY1)+(rM2-rY2)+(dM1-dY1)+(dM2-dY2)\}/2+\{(\Delta rM1-\Delta rY1)+(\Delta rM2-\Delta rY2)+(\Delta dM1-\Delta dY1)+(\Delta dM2-\Delta dY2)\}/2 \quad (4)$$

In the equation (4), the second term "{(ΔrM1−ΔrY1)+(ΔrM2−ΔrY2)+(ΔdM1−ΔdY1)+(ΔdM2−ΔdY2)}/2" indicates how large the correction errors are in the results detected by the respective detection methods.

In the correction errors, "(ΔrM1−ΔrY1)+(ΔrM2−ΔrY2)" is an error generated by the method that detects normal reflected light, and "(ΔdM1−ΔdY1)+(ΔdM2−ΔdY2)" is an error generated by the method that detects diffuse reflected light. In the present exemplary embodiment, the one side corresponds to the sensor 60*a* that detects normal reflected light, and may produce a detection error due to a scratch, a foreign substance, and the like with a higher probability according to a change on the intermediate transfer belt 10 over time. The other side corresponds to the sensor 60*b* that detects diffuse reflected light, and tends to have a detection error increasing due to a reduction and unevenness in the toner density according to a change in the toner cartridge over time.

Therefore, "(ΔrM1−ΔrY1)+(ΔrM2−ΔrY2)" and "(ΔdM1−ΔdY1)+(ΔdM2−ΔdY2)" do not increase in a similar manner unless both the intermediate transfer belt 10 and the toner cartridge show changes over time in a similar manner. In other words, existence of a scratch or a foreign substance according to a change on the intermediate transfer belt 10 over time results in generation of the detection error corresponding to "{(ΔrM1−ΔrY1)+(ΔrM2−ΔrY2)}/2". Further, a reduction or unevenness in the toner density according to a change in the toner cartridge over time results in generation of the detection error corresponding to "{(ΔdM1−ΔdY1)+(ΔdM2−ΔdY2)}/2".

In this manner, the present exemplary embodiment uses a plurality of sensors that operate according to different detection methods, and therefore can set a different requirement for generation of a detection error by each of the plurality of sensors. Then, the present exemplary embodiment can correct the positional deviation while reducing an influence of a detection error generated by a specific detection method, by correcting the positional deviation after calculating an average of the detection results produced by the plurality of sensors. In other words, for example, the present exemplary embodiment can reduce the influence of the detection error generated by each sensor to half, by combining the two sensors, the sensor 60*a* that operates according to the method that detects normal reflected light and the sensor 60*b* that operates according to the method that detects diffuse reflected light. For example, suppose that a detection error is generated due to the influence of a scratch or a foreign substance in the detection result produced by the sensor 60*a* that operates according to the method that detects normal reflected light, and no detection error is generated in the detection result produced by the sensor 60*b* that operates according to the method that detects diffuse reflected light. In this case, the present exemplary embodiment can reduce the influence of the detection error to half by calculating an average of the detection results, compared to an image forming apparatus using two sensors both of which operate according to the method that detects normal reflected light, as described with reference to the above-described equation. Therefore, the present exemplary embodiment can reduce the influence of a change over time, which occurs in the course of use of the image forming apparatus, thereby reducing the deterioration in the accuracy of the positional deviation correction in the method that detects normal reflected light and the method that detects diffuse reflected light.

Further, the present exemplary embodiment can also correct a positional deviation while reducing a detection error in a similar manner, for not only the positional deviation in the sub scanning direction but also a positional deviation in a main scanning direction. A relative positional deviation amount rRsym in the main scanning direction, which is detected by the sensor 60*a*, can be calculated by the following equation (5).

$$rRsym=\{(rM1+\Delta rM1)-(rY1+\Delta rY1)\}-\{(rM2+\Delta rM2)-(rY2+\Delta rY2)\}-Wref_ym$$

$$=\{(rM1-rY1)-(rM2-rY2)\}+\{(\Delta rM1-\Delta rY1)-(\Delta rM2-\Delta rY2)\}-Wref_ym \quad (5)$$

In this equation, Wref_ym represents a reference amount of a relative position in the main scanning direction. When rRsym is zero, this means that the relative positional deviation amount in the main scanning direction is zero.

Further, a relative positional deviation amount dRsym in the main scanning direction, which is detected by the sensor 60*b*, can be calculated by the following equation, an equation (6).

$$dRsym=\{(dM1+\Delta dM1)-(dY1+\Delta dY1)\}+\{(dM2+\Delta dM2)-(dY2+\Delta dY2)\}-Wref_ym \quad (6)$$

An average value Rsym of the results acquired by the sensors 60*a* and 60*b* is also calculated to average the relative positional deviation amounts from the entire image in the main scanning direction. This average value Rsym is expressed by the following equation, an equation (7).

$$Rsym=(rRsym+dRsym)/2 \quad (7)$$

In the equation (7), rRsym and dRsym are also relative positional deviation amounts in the main scanning direction, which are acquired by the different detection methods. Therefore, the present exemplary embodiment can correct the positional deviation while reducing an influence of a detection error generated by a specific detection method, by correcting the positional deviation after averaging the detection results produced by the plurality of sensors. Accordingly, the present exemplary embodiment can reduce the influence of a change over time, which occurs in the course of use of the image forming apparatus, thereby reducing the deterioration in the accuracy of the positional deviation correction in the method that detects normal reflected light and the method that detects diffuse reflected light.

Figure 10A:
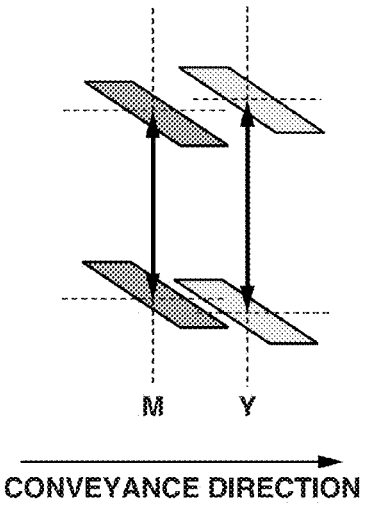
FIGS. 10A, 10B, and 10C schematically illustrate an overall magnification and an inclination in a sub scanning direction.
Figure 10B:
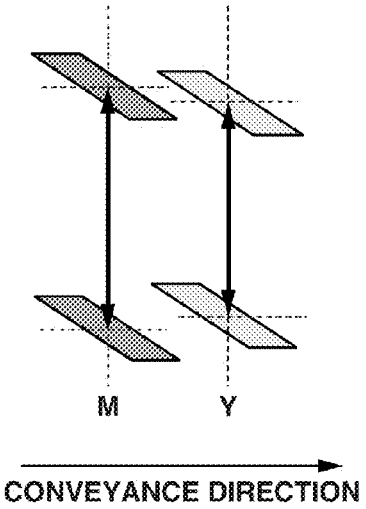
Figure 10C:
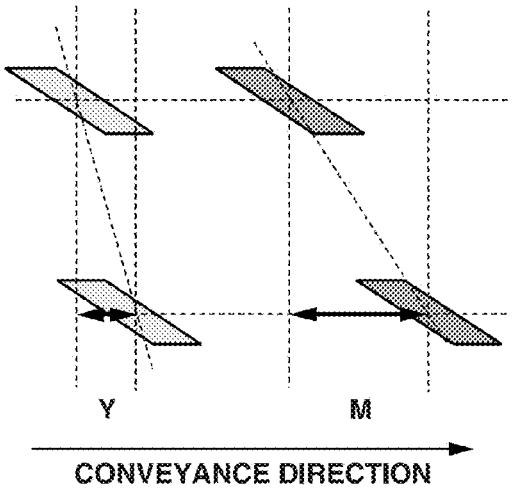

Further, the present exemplary embodiment can also correct a positional deviation while reducing a detection error in a similar manner, for an overall magnification and an inclination in the sub scanning direction. FIGS. 10A, 10B, and 10C schematically illustrate deviations of the overall magnification and the inclination in the sub scanning direction. The overall magnification means a reduction or an increase in an interval between the magenta patches compared to an interval between the yellow patches in the width direction of the intermediate transfer belt 10. FIG. 10A schematically illustrates that the interval between the magenta patches decreases, and FIG. 10B schematically illustrates that the interval between the magenta patches increases. The inclination in the sub scanning direction means an offset between the magenta patches compared to an offset between the yellow patches in the sub scanning direction. FIG. 10C schematically illustrates that the offset between the magenta patches is larger than the offset between the yellow patches.

Assuming that Psy-m and Ssy-m represent the overall magnification and the inclination in the sub scanning direction, respectively, the respective values can be calculated by the following equations, equations (8) and (9).

$$Psy\text{-}m=(W1/S1)\times(rRsym-dRsym)/2 \quad (8)$$

$$Ssy\text{-}m=(W1/S1)\times(rRpym-dRpym)/2 \quad (9)$$

In the equations (8) and (9), W1 represents a length of the recording material P in the width direction, and S1 represents an interval between the sensors 60*a* and 60*b*.

The overall magnification Psy-m and the inclination Ssy-m in the sub scanning direction are a relative positional deviation amount in the main scanning direction and a relative positional deviation amount in the sub scanning direction, which are acquired by the different detection methods, respectively. Therefore, the present exemplary embodiment can correct the positional deviation while reducing an influence of a detection error generated by a specific detection method, by correcting the positional deviation after averaging the detection results produced by the plurality of sensors. Accordingly, the present exemplary embodiment can reduce the influence of a change over time, which occurs in the course of use of the image forming apparatus, thereby reducing the deterioration in the accuracy of the positional deviation correction in the method that detects normal reflected light and the method that detects diffuse reflected light.

In this manner, the present exemplary embodiment corrects the positional deviation with use of the sensor 60*a* including the single light receiving element 62*a* that receives normal reflected light, and the sensor 60*b* including the single light receiving element 62*b* that receives diffuse reflected light. Therefore, the present exemplary embodiment can reduce the influence of a change over time, which occurs in the course of use of the image forming apparatus, thereby reducing the deterioration in the accuracy of the positional deviation correction in the method that detects normal reflected light and the method that detects diffuse reflected light. Further, the present exemplary embodiment can also prevent cost of the sensor from increasing, because each sensor uses only a single light receiving element therefor.

A second exemplary embodiment determines the toner amount of the black patch based on a detection result that the sensor 60*a*, which operates according to the method that detects normal reflected light, produces by detecting the black patch. Then, the present exemplary embodiment determines whether the positional deviation should be corrected based on a detection result that the sensor 60*b*, which operates according to the method that detects diffuse reflected light, produces by detecting the black patch. The second exemplary embodiment is characterized by this operation. In the following description, the second exemplary embodiment will be described, omitting detailed descriptions of components and features similar to the above-described exemplary embodiment.

Figure 11:
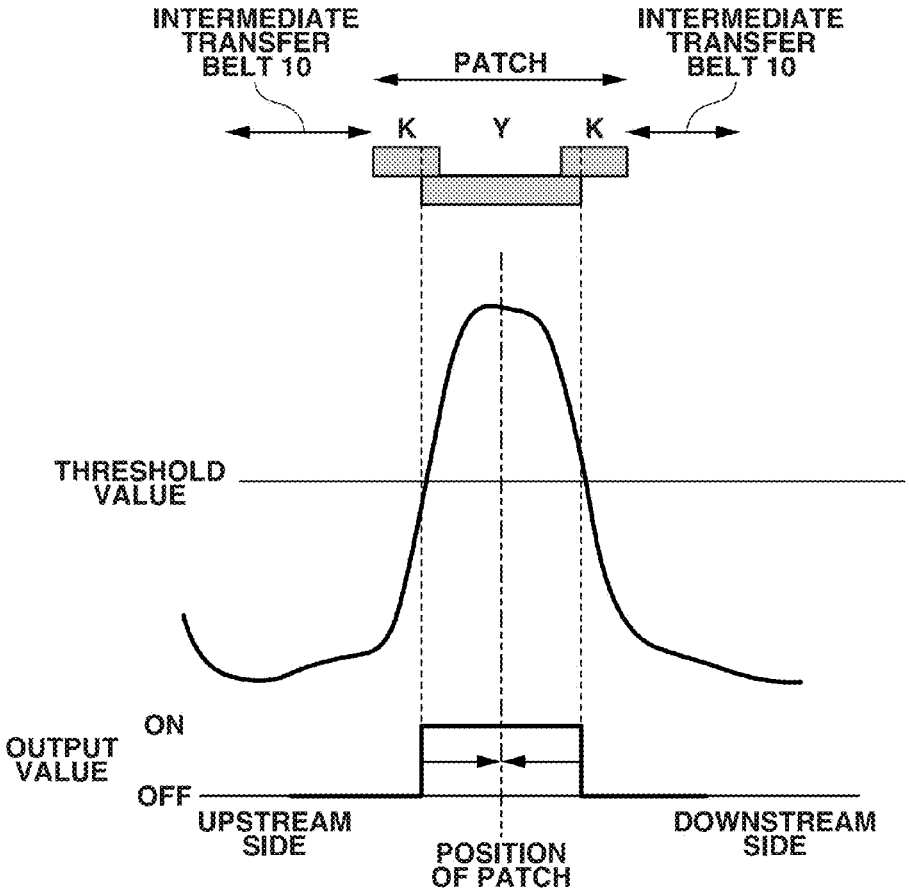
FIG. 11 illustrates an output waveform that the sensor 60*b* outputs by detecting patches 308*k*, 309*y*, and 310*k* when the black patch is formed with a reduced toner amount.

The detection of the black patch by the sensor 60*b*, which operates according to the method that detects diffuse reflected light, may lead to incorrect detection of the position of the black patch when the black patch is formed with a reduced toner amount due to a change in the toner cartridge over time or the like. FIG. 11 illustrates an output waveform that the sensor 60*b* produces by detecting patches 308*k*, 309*y*, and 310*k*, when the black patch is formed with a reduced toner amount.

The black patch is formed with a reduced toner amount, as a result of which the light emitted from the light emitting element 61*b* is not absorbed by the black patches 308*k* and 310*k*, and the diffuse reflected light from the yellow patch 309*y* laid under the black patches 308*k* and 310*k* is received by the light receiving element 62*b*. As a result, the sensor 60*b* detects a rise and a fall of the output waveform corresponding to the edges of the yellow patch 309*y*. Therefore, the sensor 60*b* may identify the position of the black patch by detecting the yellow patch 309*y* laid under the black patches 308*k* and 310 *k*, instead of detecting the edges of the black patch.

In this manner, the sensor 60*b* detects the rising edge and the falling edge affected by the reflection light from the yellow patch laid under the black patches, when the black patch to be detected by the sensor 60*b* is formed with a reduced toner amount. Therefore, the position of the patch identified from these edges is different from the position where the black patch is actually located. If the positional deviation is corrected based on the relative positional deviation amount of the black patch different from an actual amount, this correction may result in a further increase in the relative positional deviation amount. Therefore, in this case, the detection result for the correction is not used.

Figure 12:
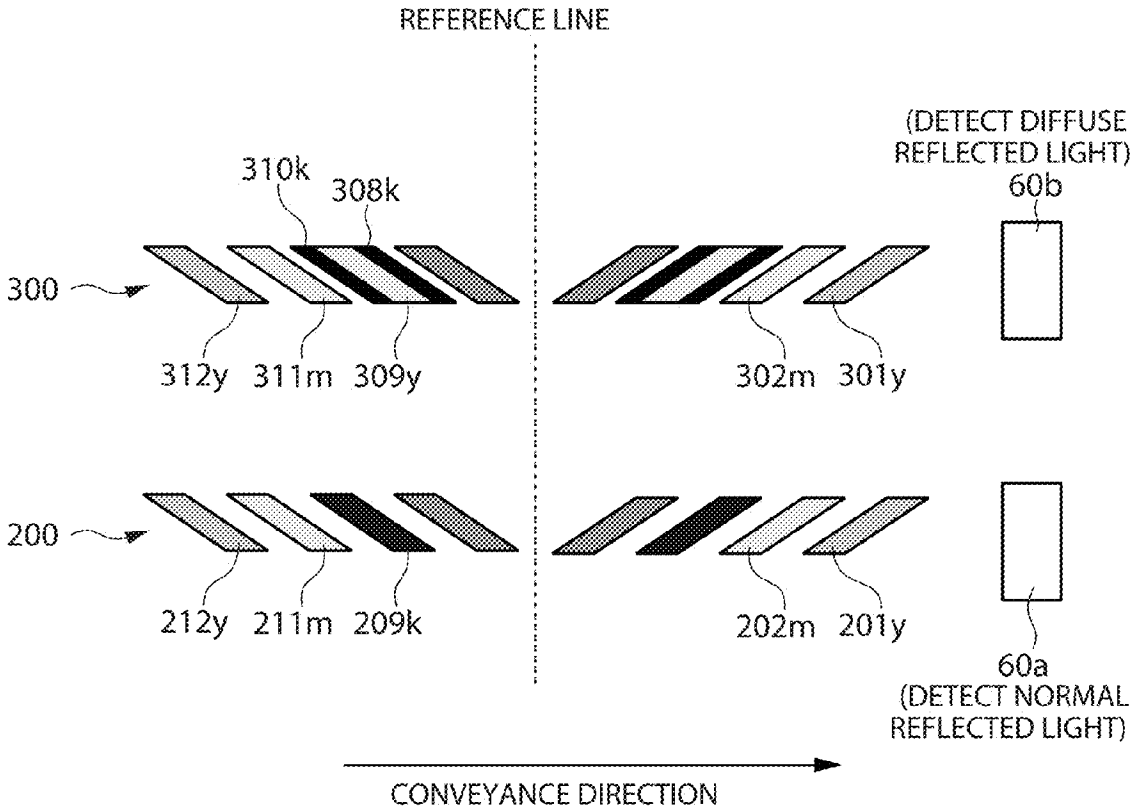
FIG. 12 illustrates details of the patches as the positional deviation correction patterns.

On the other hand, the light receiving element 62*a* of the sensor 60*a*, which operates according to the method that detects normal reflected light, detects a high output from the intermediate transfer belt 10, although it little detects the reflection light from the black patch because the infrared light is absorbed by the black patch. Therefore, the sensor 60*a* can detect the edges of the black patch. Accordingly, a threshold value for determining that the black patch is formed with a toner amount reduced to less than a predetermined amount can be set, in addition to the threshold value for detecting the intermediate transfer belt 10 and the edges of the black patch. In this manner, the present exemplary embodiment also determines the toner amount of the black patch with use of the sensor 60*a*, whereby the positional deviation correction pattern according to the present exemplary embodiment is formed in such a manner that a single patch with no black patch overlaid on any color patch is used as the black patch to be detected by the sensor 60*a*, as illustrated in FIG. 12.

Figure 13:
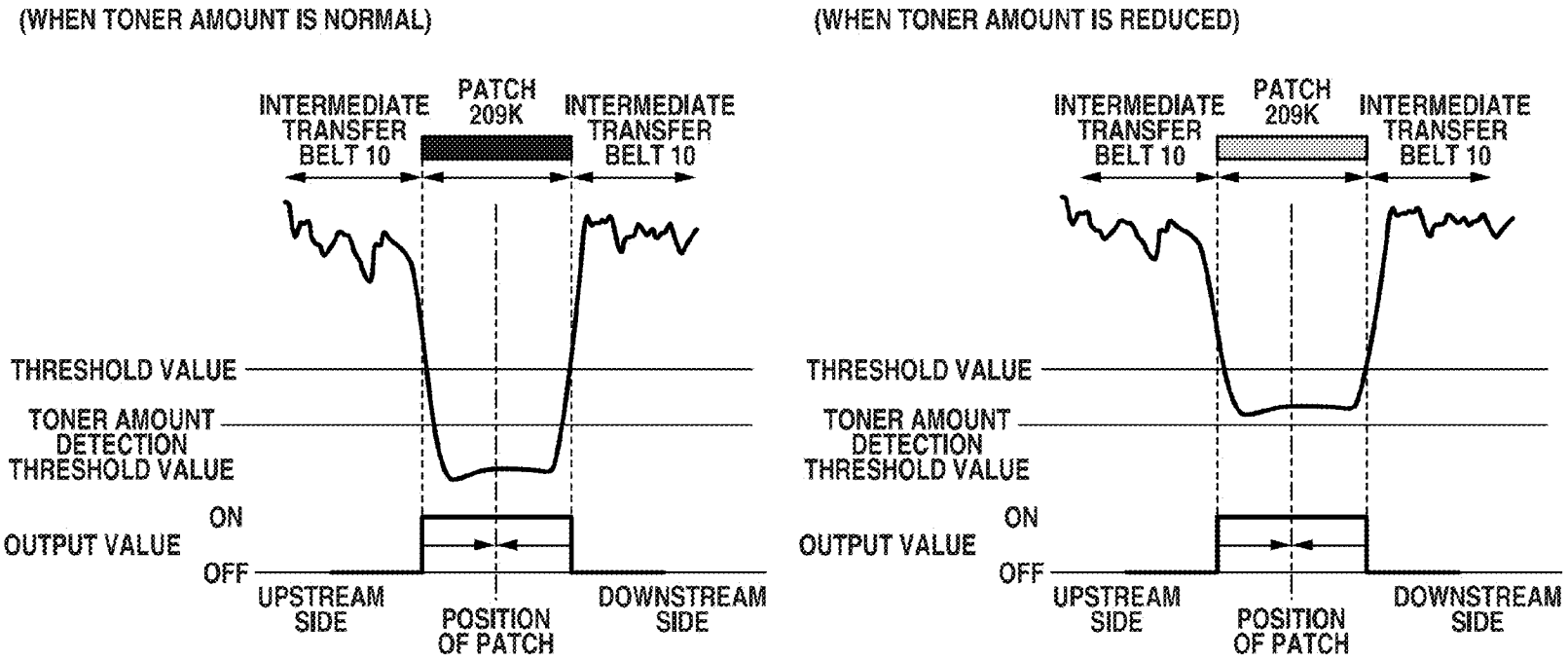
FIG. 13 illustrates output waveforms that the sensor 60*a* outputs by detecting a black patch 209*k* when the black patch 209*k* is formed with a normal toner amount and when the black patch 209*k* is formed with a reduced toner amount.

FIG. 13 illustrates output waveforms that the sensor 60*a* produces by detecting the black patch 209*k* respectively when the black patch 209*k* is formed with a normal toner amount and when the black patch 209*k* is formed with a reduced toner amount. When the black patch 209*k* is formed with the normal toner amount, the output waveform detected by the light receiving element 62*b* extends beyond a toner amount detection threshold value set to determine the toner amount of the black patch, whereby the black patch 209*k* can be determined to be formed with a predetermined or larger toner amount. On the other hand, when the black patch 209*k* is formed with the reduced toner amount, the output waveform detected by the light receiving element 62*b* does not extend beyond the toner amount detection threshold value set to determine the toner amount of the black patch. If the result detected by the sensor 60*a* does not extend beyond the toner amount detection threshold value, the black patch formed at the position of the sensor 60*b* can be determined to be highly likely formed with a reduced toner amount, too. Therefore, the position of the black patch detected by the sensor 60*b* can be determined to be a detection result affected by the yellow patch laid under the black patches.

In this case, because the position of the black patch detected by the sensor 60*b* is different from the actual position of the black patch, even correcting the positional deviation based on this detection result cannot result in an appropriate correction of the relative positional deviation amount.

For example, suppose that the actual black patch is located with no relative positional deviation amount generated, but a detection result of the sensor 60*b* indicates that there is a relative positional deviation amount due to a reduced toner amount with which the black patch is formed. In this case, correcting the positional deviation results in an even larger increase in the relative positional deviation. Therefore, if the toner amount of the black patch is determined to be smaller than a predetermined amount as a result that the sensor 60*a* produces by detecting the black patch, the present exemplary embodiment refrains from correcting the positional deviation based on the result detected by the sensor 60*b* to prevent the relative positional deviation amount from further largely increasing. The present exemplary embodiment refrains from correcting the relative positional deviation amount as processing when determining not to use the detection result that the sensor 60*b* produces by detecting the black patch. Alternatively, the present exemplary embodiment corrects the relative positional deviation amount only using the result produced by the sensor 60*a*. Further alternatively, the present exemplary embodiment performs control of issuing a request for replacing the black toner cartridge.

In this manner, the present exemplary embodiment determines the toner amount of the black patch based on the detection result that the sensor 60*a*, which operates according to the method that detects normal reflected light, produces by detecting the black patch. Then, the present exemplary embodiment determines whether to correct the positional deviation based on the detection result that the sensor 60*b*, which operates according to the method that detects diffuse reflected light, produces by detecting the black patch. As a result, if the toner amount of the black patch is determined to be smaller than the predetermined amount, the present exemplary embodiment refrains from correcting the positional deviation based on the result detected by the sensor 60*b*, thereby succeeding in preventing the relative positional deviation amount from further largely increasing.

In the present exemplary embodiment, only a single patch is used as the black patch to be detected by the sensor 60*a* by way of example, but it is not limited thereto. For example, another black patch than the positional deviation correction pattern may be formed as a toner amount determination patch for determining the toner amount of the black patch.

The above-described first and second exemplary embodiments have been described based on the example in which each sensor emits the light from a bullet-shaped LED, and receives the light by a bullet-shaped phototransistor. On the other hand, a third exemplary embodiment will be described as an example that performs control for correcting the positional deviation with use of a sensor that emits the light from a chip-type LED. In the following description, the third exemplary embodiment will be described, omitting detailed descriptions of components and features similar to the above-described exemplary embodiments.

Description of Sensors

Figure 14A:
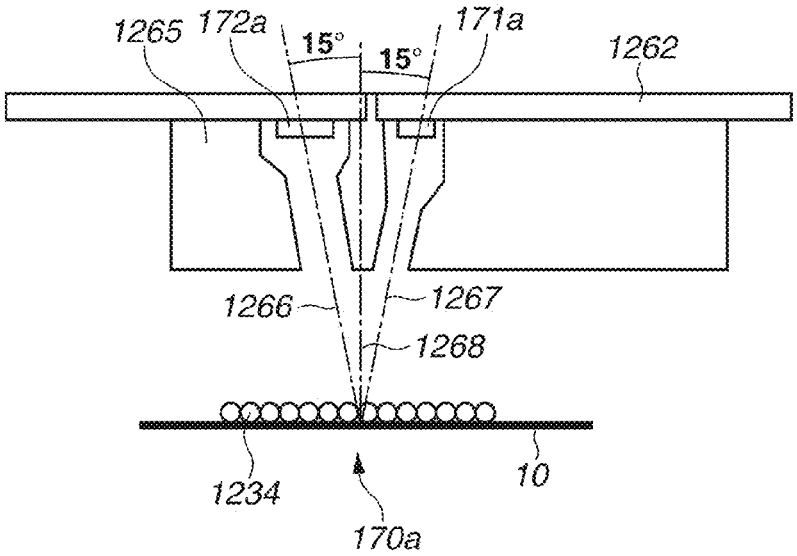
FIGS. 14A and 14B are cross-sectional views of sensors 170*a* and 170*b*, respectively.
Figure 14B:
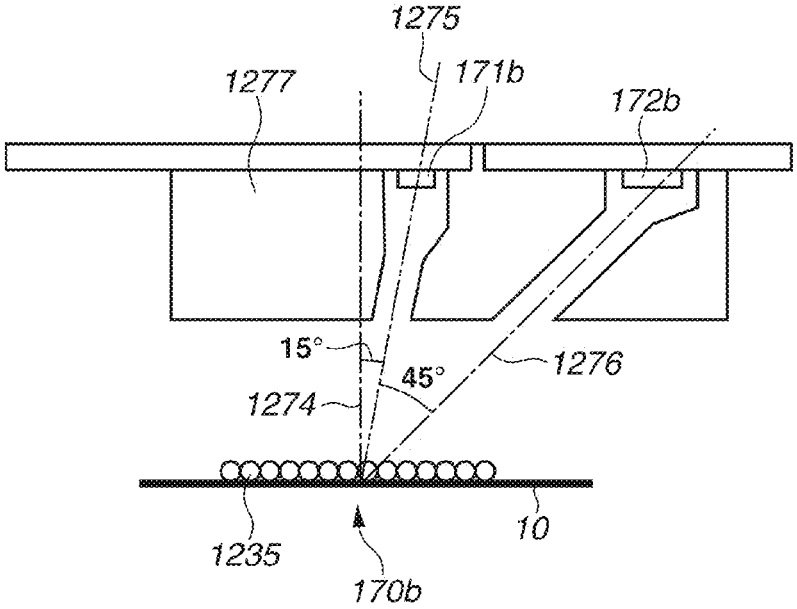

FIGS. 14A and 14B are cross-sectional views of a sensor 170*a* and a sensor 170*b*, respectively. First, the sensor 170*a* will be described with reference to FIG. 14A. The sensor 170*a* detects normal reflected light from the intermediate transfer belt 10 or a patch 1234. A chip LED 171*a* and a chip light receiving element 172*a* are mounted on a circuit substrate 1262, and are soldered thereon. A housing 1265 defines light guide paths of the respective chip LED 171*a* and chip light receiving element 172*a*. The chip LED 171*a* and the chip light receiving element 172*a* are disposed in such a manner that central lines 1267 and 1266 of the respective light paths define angles of 15 degrees from a direction 1268 perpendicular to the intermediate transfer belt 10 symmetrically about the direction 1268. The chip LED 171*a* and the chip light receiving element 172*a* are disposed in this manner, by which direct reflection light (normal reflected light) reflected by the intermediate transfer belt 10 or the patch 1234 can be introduced into the light guide path on the light receiving side as efficient as possible in a similar manner to the above-described first exemplary embodiment. A chip-type phototransistor or the like can be used as the chip light receiving element 172*a*, and it is possible to reduce the size of the light receiving element 172*a* compared to the lamp-type phototransistor.

Next, the sensor 170*b* will be described with reference to FIG. 14B. The sensor 170*b* detects diffuse reflected light (irregular reflected light) from a patch 1235. A chip LED 171*b* and a chip light receiving element 172*b* are mounted on a circuit substrate, and are soldered thereon. A housing 1277 defines light guide paths of the respective chip LED 171*b* and chip light receiving element 172*b*. The chip LED 171*b* is disposed in such a manner that a central line 1275 of the light path on the light emitting side has an angle of 15 degrees from a direction 1274 perpendicular to the intermediate transfer belt 10. Further, the chip light receiving element 172*b* is disposed in such a manner that a central line 1276 of the light path on the light receiving side has an angle of 45 degrees from the direction 1274 perpendicular to the intermediate transfer belt 10. The chip LED 171*a* and the chip light receiving element 172*b* are disposed in this manner, by which the direct reflection light from the intermediate transfer belt 10 is prevented from being introduced into the light guide path on the light receiving side as much as possible in a similar manner to the above-described first exemplary embodiment. The present exemplary embodiment has been described assuming that the sensor 170*a* receives normal reflected light and the sensor 170*b* receives diffuse reflected light by way of example, but is not limited thereto. The present exemplary embodiment may be configured in such a manner that the sensor 170*a* receives diffuse reflected light and the sensor 170*b* receives normal reflected light. Further, it can be also said that the chip light receiving element 172*a* of the sensor 170*a* is arranged so as to be located in a direction in which the light emitted from the chip LED 171*a* is specularly reflected, among directions in which this light is reflected. On the other hand, it can be also said that the chip light receiving element 172*b* of the sensor 170*b* is arranged so as to be located in a different direction from a direction in which the light emitted from the chip LED 171*b* is specularly reflected, among directions in which this light is reflected.

The configurations illustrated in FIGS. 14A and 14B employ resin mold-type optical elements for the LEDs 171*a* and 171*b* as the light emitting elements, and the light receiving elements (phototransistors or photodiodes) 172*a* and 172*b*. These configurations are characterized in that they include a lead frame so as to allow each of the light emitting element and the light receiving element to be turned in a different direction freely to some degree through a change in an angle at which the lead frame is bent, thereby improving flexibility in terms of an angle and a position at which each of the light emitting element and the light receiving element is arranged. Therefore, it is possible to turn an optically characteristically excellent direction (for example, a direction of the LED that can emit the light with a high intensity, and a direction of the light receiving element that is highly sensitive to the light) toward a measurement target. Accordingly, it is possible to fully utilize the capabilities of the light emitting element and the light receiving element in terms of the intensity of the light emitted to the measurement target and the sensitivity of receiving the reflection light. However, the presence of the lead frame leads to a certain volume from the light emitting element or the light receiving element to the circuit substrate, thereby resulting in a slight increase in the size of the sensor as a whole.

Figure 15A:
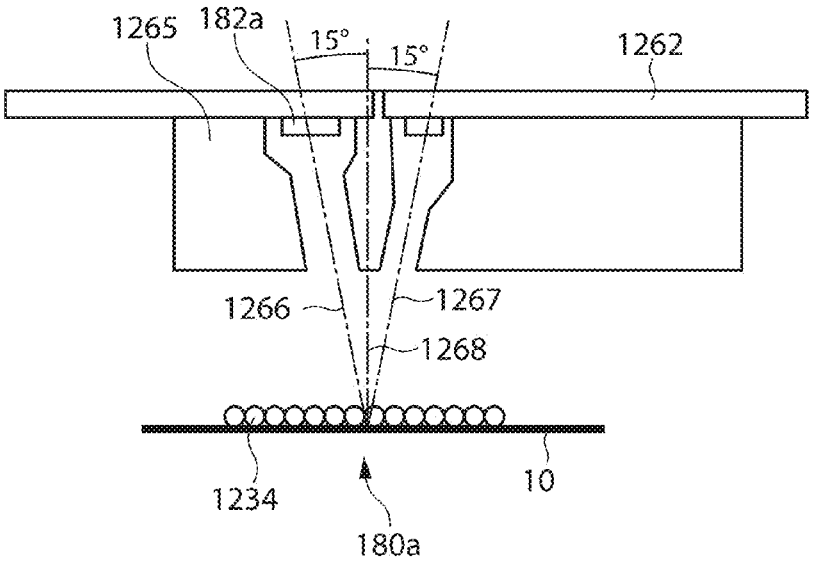
FIGS. 15A and 15B are cross-sectional views of sensors 180*a* and 180*b*, respectively.
Figure 15B:
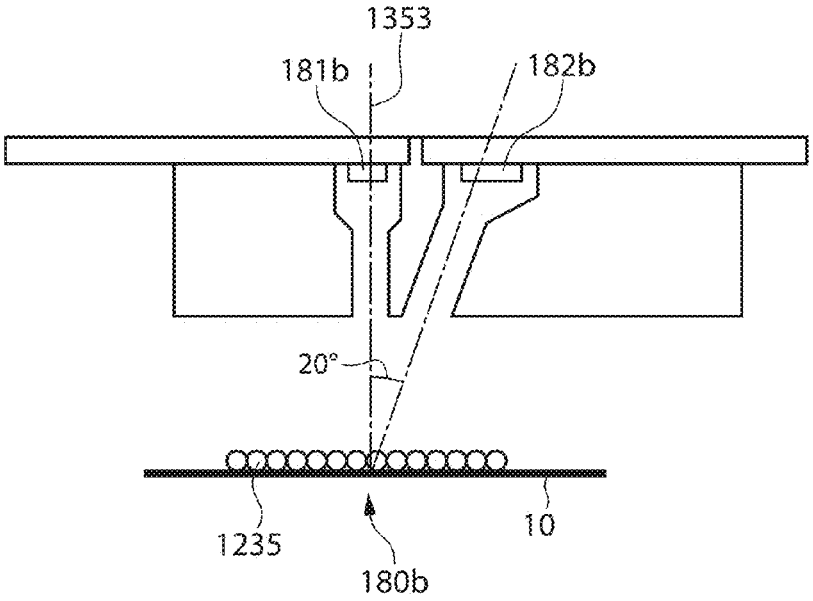
Figure 16:
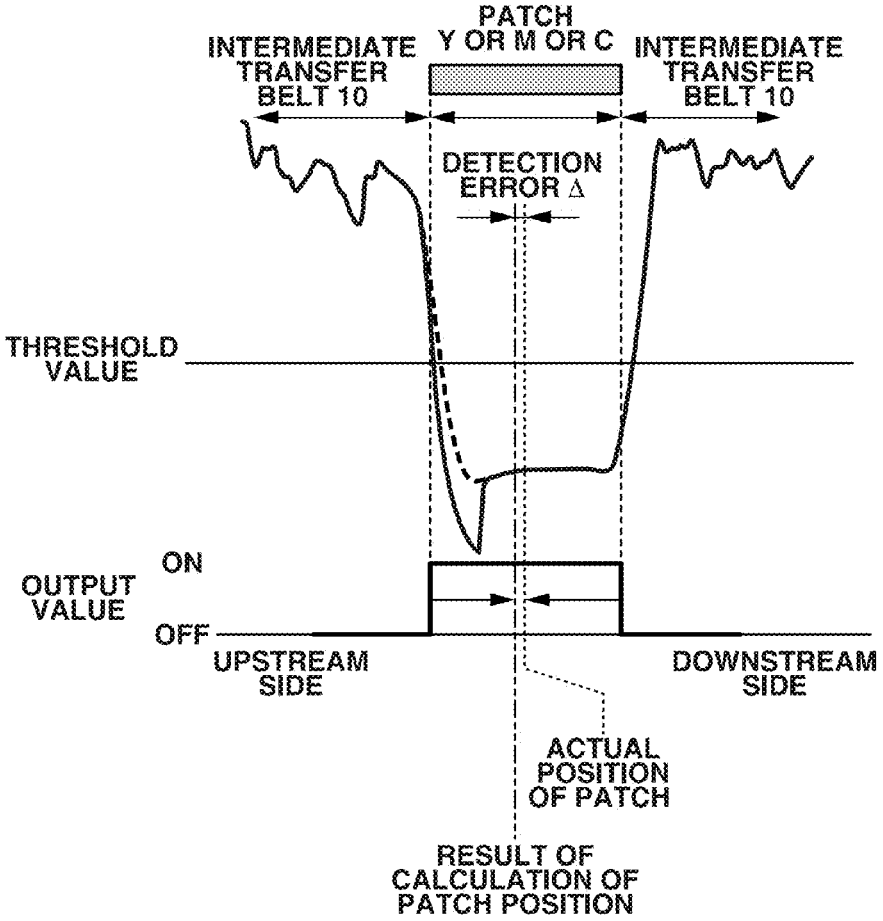
FIG. 16 illustrates a change in a detection result when a scratch or a foreign substance exists on an intermediate transfer member.
Figure 17:
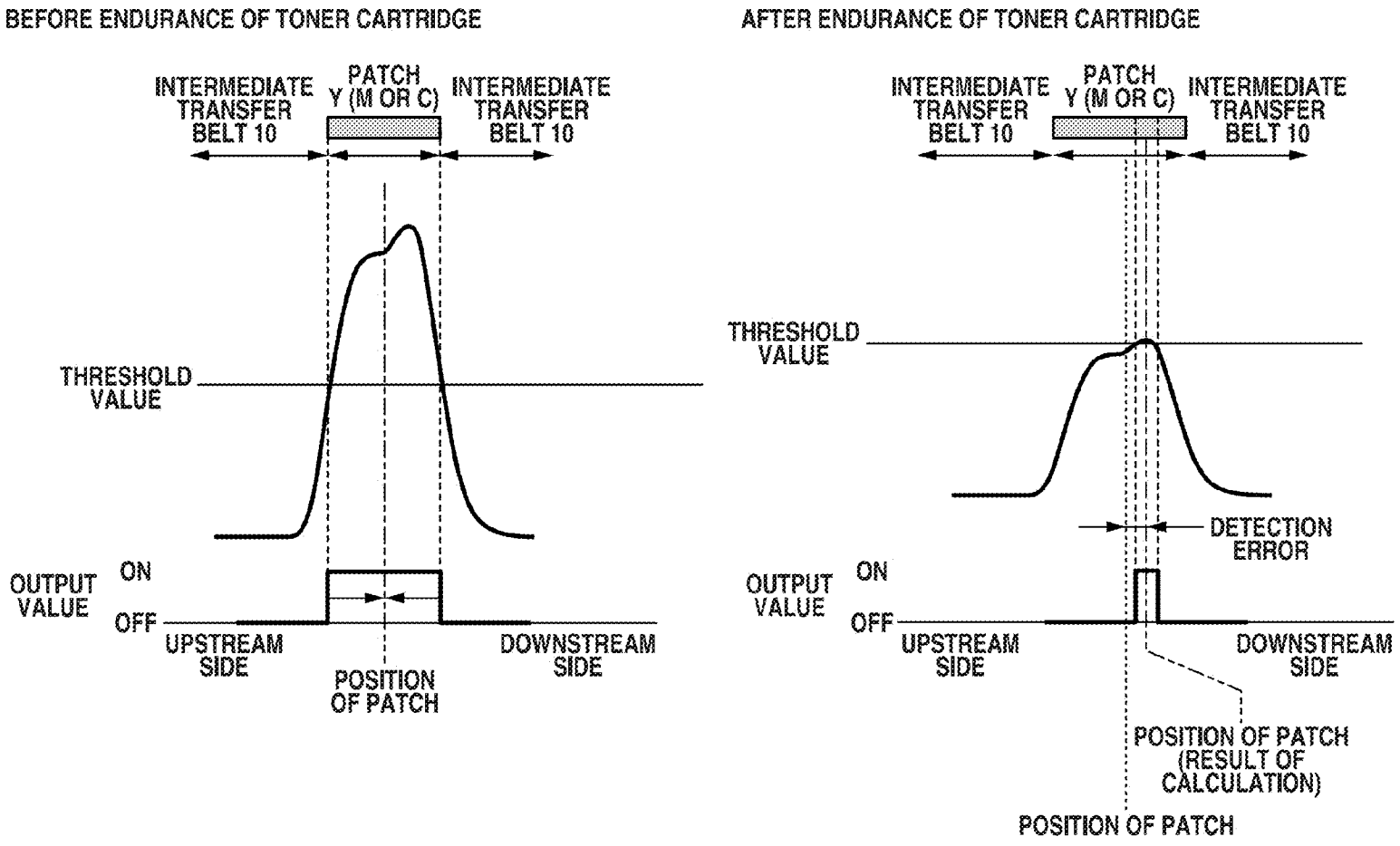
FIG. 17 illustrates output waveforms of a patch before and after endurance of a toner cartridge.

Therefore, sensors illustrated in FIGS. 15A and 15B can be also used in consideration of a reduction in the size of the sensor. The sensors illustrated in FIGS. 15A and 15B employ surface mount-type optical elements, in which a chip is directly mounted on a surface of a circuit substrate, with no lead frame used therein, thereby realizing a size reduction compared to the sensors 170*a* and 170*b* illustrated in FIGS. 14A and 14B. For the surface mount-type optical elements, the optically characteristically excellent direction is a direction perpendicular to the surface on which the optical element is mounted. Therefore, the LED emits the light with a lower intensity, and the light receiving element becomes less sensitive to the light, according to an increase in an angle of the light path from the direction perpendicular to the surface on which the optical element is mounted. In the sensors illustrated in FIGS. 15A and 15B, the optical elements are disposed in consideration of this characteristic.

First, a sensor 180*a* will be described with reference to FIG. 15A. The sensor 180*a* is a sensor that detects normal reflected light from the intermediate transfer belt 10 or the patch 1234, and is configured in a similar manner to the above-described sensor 170*a* illustrated in FIG. 14A. Therefore, a detailed description thereof will be omitted here.

Next, a sensor 180*b* will be described with reference to FIG. 15B. The sensor 180*b* detects diffuse reflected light from the patch 1235. Because of use of the surface mount-type optical element, the light guide path of the optical element may be aligned with the direction perpendicular to the surface on which the light emitting or receiving element is mounted as close as possible, to improve the light emission intensity or the light receiving sensitivity. In the example illustrated in FIG. 15B, an LED 181*b* as the light emitting element is disposed in such a manner that a central line of a light path thereof is in alignment with a direction 1353 perpendicular to the intermediate transfer belt 10. Further, a light receiving element 182*b* is disposed in such a manner that a central line of a light guide path thereof has an angle of 20 degrees from the direction 1353 perpendicular to the intermediate transfer belt 10. The sensor 180*b* is configured in this manner, by which the light emitting element can emit the light with an improved intensity. However, the light guide path on the light receiving side is located close to a reflection region of the normal reflected light from the intermediate transfer belt 10, whereby the normal reflected light from the intermediate transfer belt 10 may be partially introduced into the light receiving side. Therefore, as another possible configuration, the sensor 180*b* can be configured in such a manner that the LED 181*b* is disposed with the central line of the light path thereof defining an angle of 20 degrees from the direction 1353 perpendicular to the intermediate transfer belt 10, and the light receiving element 182*b* is disposed with the central line of the light path thereof in alignment with the direction 1353 perpendicular to the intermediate transfer belt 10.

Principle for Calculating Relative Color Deviation Amount

Next, a principle for calculating the relative color deviation amount according to the present exemplary embodiment when the sensors 180*a* and 180*b* illustrated in FIGS. 15A and 15B are used will be described. When detecting a patch, the sensor 180*a* illustrated in FIG. 15A, which operates according to the method that detects normal reflected light, produces an output waveform as illustrated in FIG. 5. Since the light receiving element 182*a* mainly detects normal reflected light, the sensor 180*a* can produce a high output with respect to the reflection light from the intermediate transfer belt 10 while producing a low output with respect to the reflection light from a chromatic patch. Therefore, the present exemplary embodiment can detect edges of the patch at both ends thereof according to changes beyond a preset edge threshold value in an output when detecting the chromatic patch, thereby identifying the position of the patch from the edges at the both ends.

Further, when detecting the chromatic patch such as the yellow patch, the magenta patch, and the cyan patch, the sensor 180*b* illustrated in FIG. 15B, which operates according to the method that detects diffuse reflected light, produces an output waveform as illustrated in FIG. 6. Since the light receiving element 182*b* mainly detects diffuse reflected light, the sensor 180*b* produces a low output with respect to the reflection light from the intermediate transfer belt 10 while producing a high output with respect to the reflection light from the chromatic patch. Therefore, the present exemplary embodiment can detect edges of the patch at both ends thereof according to changes beyond a preset edge threshold value in an output when detecting the chromatic patch, thereby identifying the position of the patch from the edges at the both ends. On the other hand, the black patch absorbs the infrared light emitted from the LED 181*b*, and therefore cannot be distinguished from the intermediate transfer belt 10. Therefore, in the present exemplary embodiment, the patch for the black color is also formed by overlaying black patches on a yellow patch at both ends of the yellow patch. The output waveform produced at this time is as illustrated in FIG. 7. The present exemplary embodiment can estimate that edges of the black patch are detected according to changes beyond the edge threshold value in an output when the light receiving element 182*b* detects the reflection light from the yellow patch, thereby identifying the position of the black patch from the edges at the both ends.

Further, as described in the first exemplary embodiment, the present exemplary embodiment can acquire the relative positional deviation amounts in the sub scanning direction and the main scanning direction, the overall magnification, and the inclination in the sub scanning direction by calculating the distance between the patches of the respective colors. Further, the present exemplary embodiment corrects the positional deviation based on the detection results output from both the sensor 180*a*, which operates according to the method that detects normal reflected light, and the sensor 180*b*, which operates according to the method that detects diffuse reflected light, in a similar manner to the above-described first exemplary embodiment. Therefore, the present exemplary embodiment can reduce the influence of a change over time, which occurs in the course of use of the image forming apparatus, thereby reducing the deterioration in the accuracy of the positional deviation correction in the method that detects normal reflected light and the method that detects diffuse reflected light.

A dynamic range between an output detected from a solid image and an output detected when the toner amount is zero may be maximized, to allow the patch output detected by the sensor 180*a* or 180*b* to stably fall below or exceed the edge threshold value. Since the sensor 180*b* is configured in such a manner that only the small angle of 20 degrees is defined between the light patch axis of the LED 181*b* and the light path axis of the light receiving element 182*b* so that the normal reflected light is partially incident on the light receiving element 182*b*, thereby reducing the dynamic range compared to a sensor having an angle larger than 20 degrees. However, the present exemplary embodiment can be carried out by preparing 1.0 V or higher as an absolute value of the dynamic range, or by preparing 1.5 V or higher.

In this manner, use of the sensor including the chip-type LED can realize a reduction in the size of the sensor. Further, one of the sensors is configured to mainly receive normal reflected light by the light receiving element, and the other of the sensors is configured to mainly receive diffuse reflected light by the light receiving element. As a result, the present exemplary embodiment can reduce the influence of a change over time, which occurs in the course of use of the image forming apparatus, thereby reducing the deterioration in the accuracy of the positional deviation correction in the method that detects normal reflected light and the method that detects diffuse reflected light.

Application Examples

The above-described respective exemplary embodiments have been described based on the example configured to detect normal reflected light by the sensor 60*a* and detect diffuse reflected light by the sensor 60*b*. However, these exemplary embodiments are not limited thereto, and may be configured to detect diffuse reflected light by the sensor 60*a* and detect normal reflected light by the sensor 60*b*. Further, for convenience of the description, the exemplary embodiments have been described based on the example that uses two sensors, but similar control can be performed even with use of a plurality of sensors more than two sensors.

Further, the above-described respective exemplary embodiments have been described based on the example that forms the positional deviation correction patterns on the intermediate transfer belt 10 as the rotating member, but are not limited thereto. The rotating member on which the positional deviation correction patterns are formed may be any member that allows the formed positional deviation correction patterns to be detected, such as the photosensitive drum 1 and an electrostatic conveyance belt that conveys the recording material P.

According to the configuration of the present invention, it is possible to reduce the deterioration in the accuracy of the positional deviation correction in the method that detects normal reflected light and the method that detects diffuse reflected light.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-188450 filed Sep. 11, 2013, which is hereby incorporated by reference herein in its entirety.

What is claimed is:

1. An image forming apparatus comprising:

a rotating member;

a plurality of development units configured to form a plurality of positional deviation correction patterns, each of which includes a plurality of patches, onto the rotating member;

a first detection unit including a first light receiving element arranged in a direction in which light emitted from a first light emitting element toward a first positional deviation correction pattern including the plurality of patches, and reflected from the first positional deviation correction pattern is specularly reflected;

a second detection unit including a second light receiving element arranged in a direction different from a direction in which light emitted from a second light emitting element toward a second positional deviation correction pattern including at least a patch formed by a same development unit as a development unit that forms any of the patches included in the first positional deviation correction pattern, and reflected from the second positional deviation correction pattern is specularly reflected; and a control unit configured to correct a positional deviation based on a value calculated from a first detection result detected by the first detection unit and a second detection result detected by the second detection unit, wherein the value is an average value of the first detection result and the second detection result.

2. The image forming apparatus according to claim 1, wherein the control unit determines whether to correct the positional deviation with use of a detection result that the second detection unit detects a black patch in the second positional deviation correction pattern, based on a detection result that the first detection unit detects a black patch in the first positional deviation correction pattern.

3. The image forming apparatus according to claim 1, wherein the first detection unit and the second detection unit are disposed so that respective detection regions thereof on the rotating member do not overlap each other in a direction perpendicular to a direction in which the rotating member rotates.

4. The image forming apparatus according to claim 1, wherein the first positional deviation correction pattern and the second positional deviation correction pattern are formed so as not to overlap each other in a direction perpendicular to a direction in which the rotating member rotates.

5. The image forming apparatus according to claim 1, wherein at least one of the first and second light emitting elements includes a bullet-shaped LED or a chip-type LED.

6. The image forming apparatus according to claim 1, wherein at least one of the first and second light receiving elements includes a bullet-shaped phototransistor or a chip-type phototransistor.

7. The image forming apparatus according to claim 1, wherein the first positional deviation correction pattern and the second positional deviation correction pattern are unfixed images.

8. The image forming apparatus according to claim 1, wherein the first light receiving element receives normal reflected light, and the second light receiving element receives diffuse or irregular reflection light.

9. The image forming apparatus according to claim 1, wherein the first detection unit includes only a single light emitting element as the first light receiving element, and the second detection unit includes only a single light receiving element as the second light receiving element.

10. The image forming apparatus according to claim 1, wherein the first positional deviation correction pattern and the second positional deviation correction pattern are continuously connected in a direction perpendicular to a direction in which the rotating member rotates.

11. A positional deviation detection apparatus used for an image forming apparatus for correcting a positional deviation, the positional deviation detection apparatus comprising:

a first detection unit including a first light receiving element arranged in a direction in which light emitted from a first light emitting element toward a first positional deviation correction pattern formed on a rotating member and including a plurality of patches, and reflected from the first positional deviation correction pattern is specularly reflected; and a second detection unit including a second light receiving element arranged in a direction different from a direction in which light emitted from a second light emitting element toward a second positional deviation correction pattern formed on the rotating member and including at least a patch formed by a same development unit as a development unit that forms any of the patches included in the first positional deviation correction pattern, and reflected from the second positional deviation correction pattern is specularly reflected, wherein a value to be used for a positional deviation is calculated from a first detection result detected by the first detection unit and a second detection result detected by the second detection unit, and wherein the value is an average value of the first detection result and the second detection result.

12. A positional deviation detection apparatus used for an image forming apparatus for correcting a positional deviation, the positional deviation detection apparatus comprising:

a first detection unit including a first light receiving element arranged in a direction in which light emitted from a first light emitting element toward a first positional deviation correction pattern formed on a rotating member and including a plurality of patches, and reflected from the first positional deviation correction pattern is specularly reflected; and a second detection unit including a second light receiving element arranged in a direction different from a direction in which light emitted from a second light emitting element toward a second positional deviation correction pattern formed on the rotating member and including at least a patch formed by a same development unit as a development unit that forms any of the patches included in the first positional deviation correction pattern, and reflected from the second positional deviation correction pattern is specularly reflected, a control unit configured to calculate a value to be used for correcting a positional deviation from a first detection result detected by the first detection unit and a second detection result detected by the second detection unit, wherein the value is an average value of the first detection result and the second detection result.

13. A positional deviation detection method comprising:

detecting a first positional deviation correction pattern by a first detection unit including a first light receiving element arranged in a direction in which light emitted from a first light emitting element toward the first positional deviation correction pattern formed on a rotating member and including a plurality of patches, and reflected from the first positional deviation correction pattern is specularly reflected;

detecting a second positional deviation correction pattern by a second detection unit including a second light receiving element arranged in a direction different from a direction in which light emitted from a second light emitting element toward the second positional deviation correction pattern formed on the rotating member and including at least a patch formed by a same development unit as a development unit that forms any of the patches included in the first positional deviation correction pattern, and reflected from the second positional deviation correction pattern is specularly reflected; and detecting a positional deviation based on a value calculated from a first detection result detected by the first detection unit and a second detection result detected by the second detection unit, wherein the value is an average value of the first detection result and the second detection result.

14. The method according to claim 13, further comprising determining whether to correct the positional deviation with use of a detection result that the second detection unit detects a black patch in the second positional deviation correction pattern, based on a detection result that the first detection unit detects a black patch in the first positional deviation correction pattern.

15. The method according to claim 13, wherein at least one of the first and second light emitting elements includes a bullet-shaped LED or a chip-type LED.

16. The method according to claim 13, wherein at least one of the first and second light receiving elements includes a bullet-shaped phototransistor or a chip-type phototransistor.

17. The method according to claim 13, wherein the first light receiving element receives normal reflected light, and the second light receiving element receives diffuse or irregular reflection light.

18. The method according to claim 13, wherein the first detection unit includes only a single light emitting element as the first light receiving element, and the second detection unit includes only a single light receiving element as the second light receiving element.

19. An image forming apparatus comprising:

a rotating member;

a plurality of development units configured to form a plurality of positional deviation correction patterns, each of which includes a plurality of patches, onto the rotating member;

a first detection unit including a first light receiving element arranged in a direction in which light emitted from a first light emitting element toward a first positional deviation correction pattern including the plurality of patches, and reflected from the first positional deviation correction pattern is specularly reflected;

a second detection unit including a second light receiving element arranged in a direction different from a direction in which light emitted from a second light emitting element toward a second positional deviation correction pattern including at least a patch formed by a same development unit as a development unit that forms any of the patches included in the first positional deviation correction pattern, and reflected from the second positional deviation correction pattern is specularly reflected; and a control unit configured to correct a positional deviation based on a value calculated from a first detection result detected by the first detection unit and a second detection result detected by the second detection unit, wherein the control unit determines whether to correct the positional deviation with use of a detection result that the second detection unit detects a black patch in the second positional deviation correction pattern, based on a detection result that the first detection unit detects a black patch in the first positional deviation correction pattern.

* * * * *